US010565970B2

(12) United States Patent
Pluta

(10) Patent No.: US 10,565,970 B2
(45) Date of Patent: Feb. 18, 2020

(54) METHOD AND A SYSTEM FOR DECOMPOSITION OF ACOUSTIC SIGNAL INTO SOUND OBJECTS, A SOUND OBJECT AND ITS USE

(71) Applicant: SOUND OBJECT TECHNOLOGIES S.A., Warsaw (PL)

(72) Inventor: Adam Pluta, Warsaw (PL)

(73) Assignee: SOUND OBJECT TECHNOLOGIES S.A., Warsaw (PL)

( * ) Notice: Subject to any disclaimer, the term of this patent is extended or adjusted under 35 U.S.C. 154(b) by 0 days.

(21) Appl. No.: 15/874,295

(22) Filed: Jan. 18, 2018

(65) Prior Publication Data

US 2018/0233120 A1 Aug. 16, 2018

Related U.S. Application Data

(63) Continuation of application No. PCT/EP2016/067534, filed on Jul. 22, 2016.

(30) Foreign Application Priority Data

Jul. 24, 2015 (EP) ..... 15002209

(51) Int. Cl.
*G10H 1/06* (2006.01)
*G10L 25/90* (2013.01)

(52) U.S. Cl.
CPC ..... *G10H 1/06* (2013.01); *G10L 25/90* (2013.01); *G10H 2210/056* (2013.01);
(Continued)

(58) Field of Classification Search
CPC ..... G10H 1/06; G10H 2210/056; G10H 2210/066; G10H 2240/145; G10H 2250/055; G10L 25/90; G10L 2025/906
(Continued)

(56) References Cited

U.S. PATENT DOCUMENTS 4,797,926 A * 1/1989 Bronson ..... G10L 19/02 704/214
5,202,528 A * 4/1993 Iwaooji ..... G10H 1/12 84/616

(Continued)

FOREIGN PATENT DOCUMENTS

JP 2007249009 A * 9/2007

OTHER PUBLICATIONS

International Preliminary Report on Patentability Chapter II for International application PCT/EP2016/067534, dated Feb. 11, 2017, specifically indication of possible allowable subject matter on p. 7 (Year: 2017).*

*Primary Examiner* — David S Warren
*Assistant Examiner* — Christina M Schreiber
(74) *Attorney, Agent, or Firm* — Siritzky Law, PLLC

(57) ABSTRACT

A method and a system for decomposition of acoustic signal into sound objects having the form of signals with slowly-varying amplitude and frequency, as well as sound objects and their use. The object is achieved by a method for decomposing an acoustic signal into digital sound objects, a digital sound object representing a component of the acoustic signal, the component having a waveform, comprising the steps of converting the analogue acoustic signal into a digital input signal (PIN); determining an instantaneous frequency component of the digital input signal, using a digital filter bank; determining an instantaneous amplitude of the instantaneous frequency component; determining an instantaneous phase of the digital input signal associated with the instantaneous frequency; creating at least one digital sound object, based on the determined instantaneous frequency, phase and amplitude; and storing the digital sound object in a sound object database.

15 Claims, 24 Drawing Sheets

(52) U.S. Cl.
CPC . *G10H 2210/066* (2013.01); *G10H 2240/145* (2013.01); *G10H 2250/055* (2013.01); *G10L 2025/906* (2013.01)

(58) Field of Classification Search
USPC ..... 84/609
See application file for complete search history.

(56) References Cited

U.S. PATENT DOCUMENTS

| | | | | |
|---|---|---|---|---|
| 6,900,381 | B2 * | 5/2005 | Lindgren | G10H 7/045 708/315 |
| 7,572,969 | B2 * | 8/2009 | Koseki | G10H 1/0041 84/604 |
| 7,807,915 | B2 * | 10/2010 | Kulkarni | G10H 1/183 84/602 |
| 9,040,800 | B2 * | 5/2015 | Shirakawa | G10H 7/02 84/603 |
| 2003/0191640 | A1 * | 10/2003 | Gemello | G10L 15/02 704/231 |
| 2005/0149321 | A1 * | 7/2005 | Kabi | G10L 25/90 704/207 |
| 2012/0116186 | A1 * | 5/2012 | Shrivastav | A61B 5/0507 600/301 |
| 2015/0228261 | A1 * | 8/2015 | Nakata | G10H 1/06 84/622 |
| 2018/0233120 | A1 * | 8/2018 | Pluta | G10L 25/90 |

* cited by examiner

| Filter No. | FN | Note | Window |
|---|---|---|---|
| 20 | 21,82Hz | F2 | 32 330 |
| 60 | 38,89 Hz | #D1 | 18 145 |
| 100 | 69,29 Hz | #C | 10 183 |
| 140 | 123,5 Hz | H | 5 715 |
| 180 | 220 ,0 Hz | a | 3 207 |
| 220 | 392,0 Hz | g1 | 1 800 |
| 260 | 698,5 Hz | f2 | 1 010 |
| 300 | 1245 Hz | #d3 | 566 |
| 340 | 2217 Hz | #c4 | 318 |
| 380 | 3951 Hz | h4 | 178 |
| 420 | 7040 Hz | a5 | 100 |
| 460 | 12540 Hz | g6 | 56 |

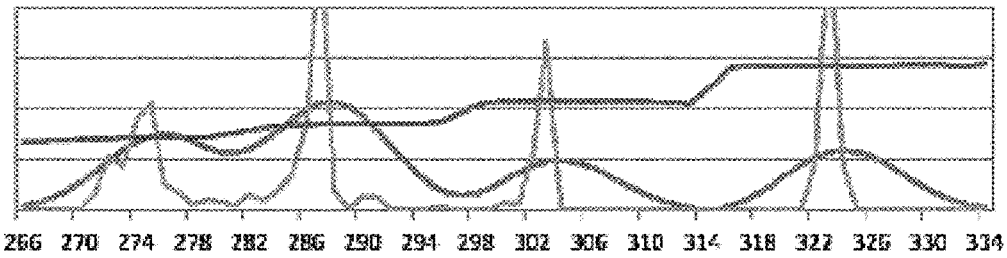

FIG.9a

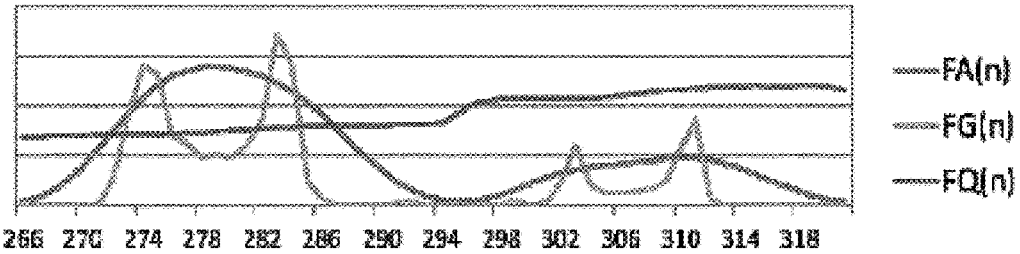

FIG.9b

Instantaneous values calculated and analyzed by the spectrum analyzing system 31.

| | |
|---|---|
| FC(n) – The real component of filter n output | |
| FS(n) – The imaginary component of filter n output | |
| FA(n) – The amplitude of filter n output | FA(n) = sqrt ( FC(n)2 + FS(n)2 ) |
| FF(n) – The spectrum's phase of filter n output | FF(n) = if ( FC(n) <> 0 ; atan ( FS(n)/FC(n) ; if ( FS(n) > 0 ; pi( ); - pi() ) ) |
| | if ( FC(n) < 0 ; if ( FS(n) > 0 ; FF(n) = FF(n) + pi() ; FF(n) = FF(n) – pi( |
| FD(n) – The slope of the phase characteristics | FD(n) = FF(n)-FF(n-1); if (FD(n) < -pi(); FD(n) = FD(n) + 2*pi();) |
| | if ( FD(n) > pi; FD(n) = FD(n) – 2*pi();) |
| FQ(n) – The angular frequency of filter n output | FQ(n) = FF(n) – $FF_{-1}$(n) ( current phase - phase of previous sample) |
| | if ( FQ(n) < 0 ; FQ(n) = FQ(n) + 2 * pi() ; ) |
| FX(n) – The filter number corresponding to FQ(n) | FX(n) = 48/ln(2) * ( ln ( FQ(n) – ln(FQ[0]) ) |
| FG(n) – The value calculated by the voting system 32 | FG( int(FX(n)) ) = FA(n) * ((FX(n) – int(FX(n) +1) |
| | FG( int(FX(n)) +1 ) = FA(n) * (FX(n) – int(FX(n)) |

FIG. 9c

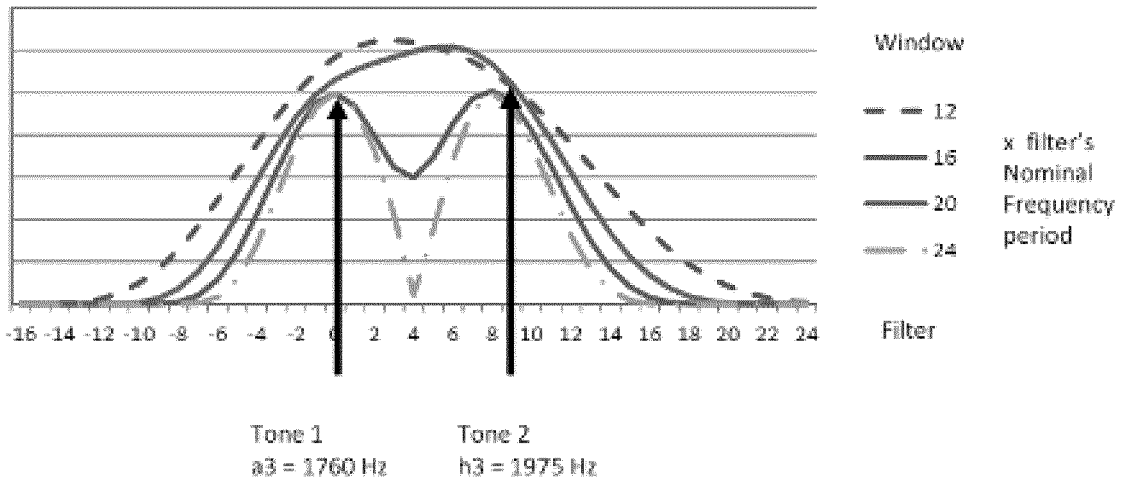
FIG.11
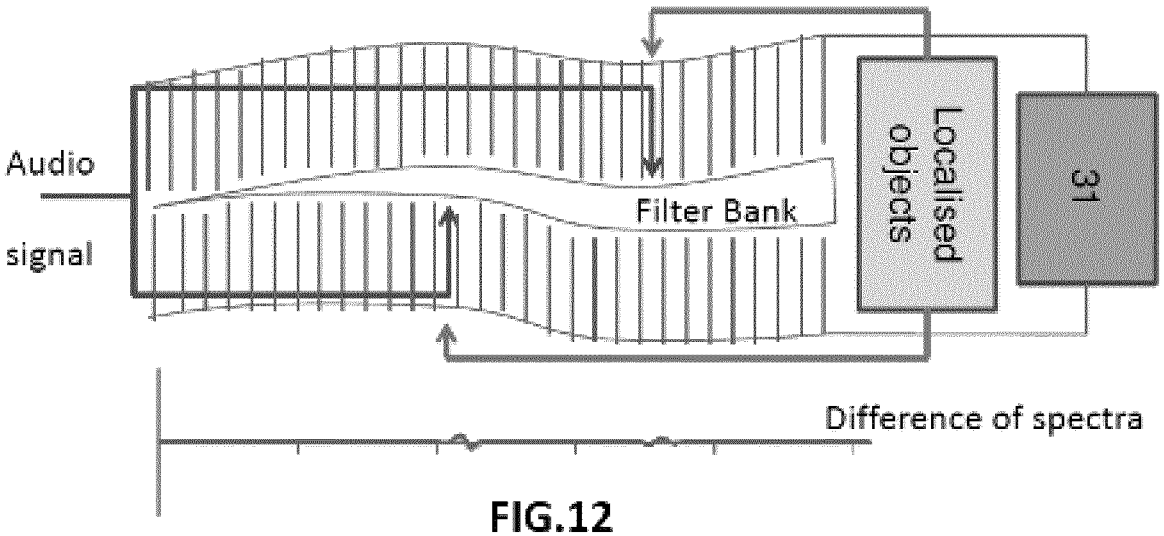
FIG.12
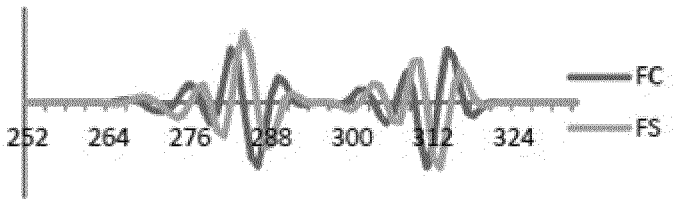
FIG. 12/2a

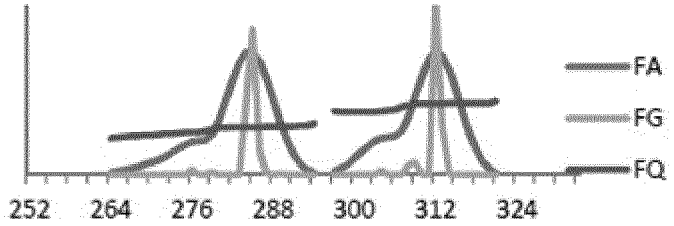
FIG. 12/2b
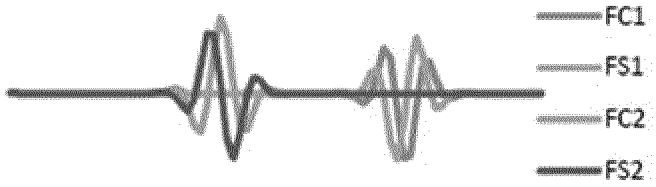
FIG. 12/2c
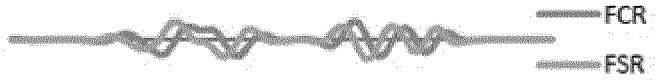
FIG. 12/2d
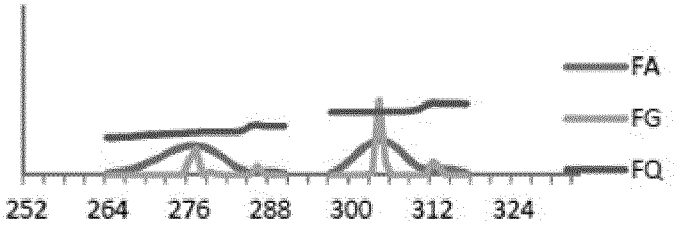
FIG. 12/2e

| | Object 0 | | | Object 1 | | | Object 2 | | | Object 3 | | |
|---|---|---|---|---|---|---|---|---|---|---|---|---|
| Point | Pos | Amp | Freq | Pos | Amp | Freq | Pos | Amp | Freq | Pos | Amp | Freq |
| 0 | 30 | 0 | 1760 | 20 | 0 | 2093 | 50 | 0 | 2637 | 40 | 0 | 3520 |
| 1 | 200 | 1700 | 1848 | 100 | 2000 | 2198 | 150 | 2000 | 2769 | 200 | 1000 | 3696 |
| 2 | 400 | 1800 | 1936 | 250 | 4000 | 2198 | 240 | 2000 | 2769 | 500 | 1000 | 3872 |
| 3 | 600 | 2600 | 2024 | 450 | 3000 | 2302 | 440 | 3000 | 2901 | 700 | 700 | 4048 |
| 4 | 800 | 0 | 2024 | 600 | 2000 | 2302 | 700 | 500 | 3033 | 910 | 0 | 4048 |
| 5 | | | | 850 | 0 | 2407 | 840 | 0 | 3033 | | | |

| Bytes | Field name | Value |
|---|---|---|
| | **Header** | |
| 4 | Header tag | "UH0 " |
| 2 | Number of channels | 0-65535 |
| 2 | Time unit | 1 |
| | **Channel** | |
| 2 | Number of channel | 0-65535 |
| 2 | Number of objets | 0-65535 |
| 4 | Start of channel | |
| | **Object** | |
| 1 | Object lewel | 0-255 |
| 1 | Number of points | 0-255 |
| 2 | Max amplitude | 0-65535 |
| 2 | Tone * 4 | |
| 4 | Start o0f object | |
| | **Punkt** | |
| 1 | Δ Amplitude | 0-255 |
| 1 | Δ Tone*4 | |
| 2 | Δ Position | 0-65535 |

FIG.15

METHOD AND A SYSTEM FOR DECOMPOSITION OF ACOUSTIC SIGNAL INTO SOUND OBJECTS, A SOUND OBJECT AND ITS USE

CROSS-REFERENCE TO RELATED APPLICATIONS

This application is a continuation of International Application No. PCT/EP2016/067534, International Filing Date Jul. 22, 2016, entitled "A Method And A System For Decomposition Of Acoustic Signal Into Sound Objects, A Sound Object And Its Use," published Feb. 2, 2017 as WO/2017/017014, claiming priority of European Patent Application No. 15002209.3, filed Jul. 24, 2015, both of which are fully incorporated herein by reference in their entirety and for all purposes.

FIELD OF INVENTION

The object of the invention is a method and a system for decomposition of acoustic signal into sound objects having the form of signals with slowly varying amplitude and frequency, and sound objects and their use. The invention is applicable in the field of analysis and synthesis of acoustic signals, e.g. in particular to speech signal synthesis.

STATE OF THE ART

For a dozen of years the progress in analysis of sound signals has been inconsiderable. Still well-known methods are used such as neural networks, wavelet analysis or fuzzy logic. Beside these methods rather widespread is the use of the classic Fast Fourier Transform (FFT) algorithm for signal filtering, which allows to analyze the frequency of components with the use of relatively low computational power.

One of the most difficult areas, but also the one being of the greatest interest within the analysis of sound signals is the analysis and synthesis of speech.

Despite huge progress being observed in the development of digital technology, the progress in sound signal processing systems in this field is not significant. During the last few years, multiple applications have appeared, which attempt to fill the niche related to recognition of speech, but their common origin (mainly the analysis in the frequency domain with the use of Fourier transform) and the limitations related to it cause that they do not respond to the demand of the market.

The main drawbacks of these systems are:

1) Vulnerability to External Interference

The existing sound analysis systems operate satisfactorily in conditions ensuring one source of the signal. If additional sources of sound appear, such as interference, ambient sounds or consonant sounds of multiple instruments, their spectrum overlap, causing the mathematical models being applied to fail.

2) Relative Variation of Spectral Parameters

Methods for calculating a sound signal's parameters which are currently used originate in the Fourier transformation. It assumes a linear variation of analyzed frequencies, meaning that a relative variation of two adjacent frequencies is not constant. For example, if a window of 1024 ($2^{10}$) data of a signal sampled with the rate of 44100 samples per second (SPS) is analyzed with the use of the FFT algorithm, then the subsequent frequencies of the spectrum differ by 43.07 Hz. The first non-zero frequency is F1=43.07 Hz, the next one F2=86.13 Hz. The last frequencies are F510=21963.9 Hz, F511=22 006,9 Hz. At the beginning of the range a relative variation of the spectral frequency is 100% and leaves no opportunity to identify the sounds being closer. At the end of the range a relative variation of the spectral parameter is 0.0019% and is undetectable for human ear.

3) Limitation of Parameters to Spectral Amplitude Characteristics

The algorithms based on the Fourier transformation use the amplitude characteristic for the analysis, and in particular the maximum of the amplitude of the spectrum. In the case of sounds with different frequencies close to each other this parameter will be strongly distorted. In this case, additional information could be obtained from the phase characteristic, analyzing the signal's phase. However, since the spectrum is analyzed in windows shifted e.g. by 256 samples, there is nothing to relate the calculated phase to.

This problem has been partly solved by the speech information extraction system, described in patent U.S. Pat. No. 5,214,708. Disclosed therein is a bank of filters having central frequencies logarithmically spaced in relation to each other, according to the model of human ear perception. Due to an assumption that within a band of any of these filter banks there is only one tone, the problem of the uncertainty principle in the field of signal processing has been partially evaded. According to the solution disclosed in U.S. Pat. No. 5,214,708, information about modulation on each of harmonics, including frequency and time-domain waveform information, can be extracted based on the measurement of the logarithm of each harmonics' power. Logarithms of signal's amplitude in adjacent filters are obtained with the use of Gaussian filters and logarithmic amplifiers. However, the drawback of this solution is that the function FM(t) used for speech analysis does not effectively extract essential characteristic parameters of a single speech signal. The next much more significant drawback of this solution is an assumption that the audio signal comprises a signal from only one source, such simplification reducing significantly practical possibilities of using such system for decomposition.

On the other hand several solutions have been proposed in respect of said problem of decomposition of an audio signal from several sources. It is known from a doctoral dissertation "Modélisation sinusoïdale des sons polyphoniques" Mathieu Lagrange, L'Université Bordeaux, 16 Dec. 2004, pages 1-220, a method and a suitable system for decomposition of acoustic signal into sound objects having the form of sinusoidal wave with slowly-varying amplitude and frequency, said method comprising a step of determining parameters of a short term signal model and a step of determining parameters of long term signal model based on said short term parameters, wherein a step of determining parameters of a short term signal model comprises a conversion of the analogue acoustic signal into a digital input signal. Determination of short-term signal model involves first detection of presence of a frequency component and then estimation of its amplitude, frequency and phase parameters. The determination of long term signal model involves grouping consecutive detected components into sounds, i.e. sound objects using different algorithms which takes into account predictable character of evolution of component parameters. Similar concept has been described also in Virtanen et Al "Separation of harmonic sound sources using sinusoidal modeling" IEEE International Conference on Acoustic, Speech, and signal Processing 2000, ICASSP '00.5-9 Jun. 2000, Piscataway, N.J. USA, IEEE, vol. 2, 5 Jun. 2000, pages 765-768 and in Tero Tolonen "Methods for Separation of Harmonic sound Sources using Sinusoidal Modeling" 106$^{th}$ Convention AES, 8 May 1999. All cited documents mention couple different methods allowing determination and estimation of frequency components. However this non-patentable literature teaches a decomposition method and system which have several drawback caused by the Fourier transform processing used therein, among other things do not allow to analyze phase in a continuous manner. Moreover, those known methods do not allow to determine frequency components in a very accurate manner by a simple mathematical operation.

Therefore, an object of the invention is to provide a method and a system for decomposition of acoustic signal, which would make possible an effective analysis of acoustic signal perceived as a signal incoming simultaneously from a number of sources, while maintaining a very good resolution in time and frequency. More generally, an object of the invention is to improve the reliability and to enhance the possibilities of sound signals' processing systems, including those for analysis and synthesis of speech.

SUMMARY OF THE INVENTION

This object is achieved by the methods and the device according to the independent claims. Advantageous embodiments are defined in the dependent claims.

According to the invention, a method for decomposition of acoustic signal into parameter sets describing subsignals of the acoustic signal having the form of sinusoidal wave with slowly-varying amplitude and frequency, may comprise a step of determining parameters of a short term signal model and a step of determining parameters of long term signal model based on said short term parameters, wherein a step of determining parameters of a short term signal model comprises a conversion of the analogue acoustic signal into a digital input signal $P_{IN}$ characterized in that in said step of determining parameters of a short term signal model the input signal $P_{IN}$ is then split into adjacent subbands with central frequencies distributed according to logarithmic scale by feeding samples of the acoustic signal to the digital filter bank's input, each digital filter having a window length proportionally to the central frequency at each filter's (20) output the real value FC(n) and the imaginary value FS(n) of the filtered signal is determined sample by sample, and then based on this the instantaneous frequency, the amplitude and the phase of all detected constituent elements of said acoustic signal are determined sample by sample, an operation improving the frequency-domain resolution of said filtered signal is executed sample by sample and involves at least a step of determining the frequency of all detected constituent elements based on maximum values of the function FG(n) resulting from a mathematical operation reflecting the number of neighboring filters (20) outputting an angular frequency value substantially similar to an angular frequency value of each consecutive filter (20), and in that in said step of determining parameters of long term signal model:

for each detected element of said acoustic signal an active object in an active objects database (34) is created for its tracking subsequent detected elements of said acoustic signal are associated sample by sample with at least selected active objects in said active objects database (34) to create a new active object or to append said detected element to an active object, or to close an active object for each active object in the database (34) values of the envelope of amplitude and values of frequency and their corresponding time instants are determined not less frequently than once per period of duration of a given filter's (20) window W(n) so as to create characteristic points describing slowly-varying sinusoidal waveform of said sound object at least one selected closed active object is transferred to a database of sound objects (35) to obtain at least one decomposed sound object, defined by a set of characteristic points with coordinates in time-frequency-amplitude space.

According to a further aspect of the invention is also that a system for decomposition of acoustic signal into sound objects having the form of sinusoidal waveforms with slowly-varying amplitude and frequency, comprises a subsystem for determining parameters of a short term signal model and a sub-system for determining parameters of a long term signal model based on said parameters, wherein said subsystem for determining short term parameters comprises a converter system for conversion of the analogue acoustic signal into a digital input signal $P_{IN}$ characterized in that said subsystem for determining short term parameters further comprises a filter bank (20) with filter central frequencies distributed according to logarithmic distribution, each digital filter having a window length proportionally to the central frequency wherein each filter (20) is adapted to determine a real value FC(n) and an imaginary value FS(n) of said filtered signal, said filter bank (2) being connected to a system for tracking objects (3), wherein said system for tracking objects (3) comprises a spectrum analyzing system (31) adapted to detect all constituent elements of the input signal $P_{IN}$, a voting system (32) adapted to determine the frequency of all detected constituent elements based on maximum values of the function FG(n) resulting from a mathematical operation reflecting the number of neighboring filters (20) which output an angular frequency value substantially similar to an angular frequency value of each consecutive filter (20), and in that said subsystem for determining long term parameters comprises a system for associating objects (33), a shape forming system (37) adapted to determine characteristic points describing slowly-varying sinusoidal waveforms, an active objects database (34) and a sound objects database (35).

According to another aspect of the invention, a sound object representing a signal having slowly-varying amplitude and frequency may be obtained by the previously described method.

Furthermore, the essence of the invention is also that a sound object representing a signal having slowly-varying amplitude and frequency may be defined by characteristic points having three coordinates in the time-amplitude-frequency space, wherein each characteristic point is distant from the next one in the time domain by a value proportional to the duration of a filter's (20) window W(n) assigned to the object's frequency.

The main advantage of the method and the system for decomposition of signal according to the invention is that it is suitable for effective analysis of a real acoustic signal, which usually is composed of signals incoming from a few different sources, e.g. a number of various instruments or a number of talking or singing persons.

The method and the system according to the invention allow to decompose a sound signal into sinusoidal components having slow variation of amplitude and frequency of the components. Such process can be referred to as a vectorization of a sound signal, wherein vectors calculated as a result of the vectorization process can be referred to as sound objects. In the method and the system according to the invention a primary objective of decomposition is to extract at first all the signal's components (sound objects), next to group them according to a determined criterion, and afterwards to determine the information contained therein.

In the method and the system according to the invention a signal is analyzed both in the time domain and in the frequency domain sample by sample. Of course this increases the demand for computational power. As already mentioned, the technologies applied so far, including the Fourier transformation with its implementation as the fast transform FFT and SFT, have played a very important role in the past when the computational power of computers was not high. However, during the last 20 years the computational power of computers has increased 100000 times. Therefore, the invention reaches for tools which are more laborious, but which offer improved accuracy and are better suited to the human hearing model.

Due to the use of a filter bank having a very large number of filters (over 300 for the audible band) with logarithmically spaced central frequencies, and due to applied operations increasing the frequency-domain resolution, one obtains a system capable of extracting two simultaneous sources of sound separated from each other even by half a tone.

A spectrum of the audio signal obtained at said filter bank's output comprises information about the current location and variations in the sound objects' signal. The task of the system and the method according to the invention is to precisely associate a variation of these parameters with existing objects, to create a new object, if the parameters do not fit to any of the existing objects, or to terminate an object if there are no further parameters for it.

In order to precisely determine the parameters of an audio signal, which are intended to be associated with existing sound objects, the number of considered filters is increased and a voting system is used, allowing to more precisely localize frequencies of the present sounds. If close frequencies appear, the length of said filters is increased for example to improve the frequency-domain resolution or techniques for suppressing the already recognized sounds are applied so as to better extract newly appearing sound objects.

The key point is that the method and the system according to the invention track objects having a frequency variable in time. This means that the system will analyze real phenomena, correctly identifying an object with a new frequency as an already existing object or an object belonging to the same group associated with the same source of signal. Precise localization of the objects' parameters in amplitude and frequency domain allows to group objects in order to identify their source. Assignment to a given group of objects is possible due to the use of specific relations between the fundamental frequency and its harmonics, determining the timbre of the sound.

A precise separation of objects makes a chance of further analysis for each group of objects, without interference, by means of already existing systems, which obtain good results for a clean signal (without interference). Possessing precise information about sound objects which are present in a signal makes it possible to use them in completely new applications such as, for example, automatic generation of musical notation of individual instruments from an audio signal or voice control of devices even with high ambient interference.

BRIEF DESCRIPTION OF DRAWINGS

The invention has been depicted in an embodiment with reference to the drawings, wherein:

FIGS. 9*a* and 9*b* show exemplary results of operation of a voting system, FIG. 9*c* shows instantaneous values calculated and analyzed by the spectrum analyzing a system 31 according to an embodiment of the invention, FIG. 11 shows the operation of a frequency resolution improvement system according to an embodiment, FIG. 12 shows the operation of a frequency resolution improvement system according to another embodiment, FIG. 12/2*a* shows a spectrum of the signal according to FIG. 7*c*, FIG. 12/2*b* shows the determined parameters of the well localized objects 284 and 312, FIG. 12/2*c* shows the spectrum of well localized objects, FIG. 12/2*d* shows the difference between the signal spectrum and the calculated spectrum of well localized objects, FIG. 12/2*e* shows the determined parameters of the objects 276 and 304 located in the spectrum of differential, FIG. 15 shows an exemplary format of notation of information about sound objects.

DETAILED DESCRIPTION OF EMBODIMENTS

In the present patent application the term "connected", in the context of a connection between any two systems, should be understood in the broadest possible sense as any possible single or multipath, as well as direct or indirect physical or operational connection.

Figure 1:
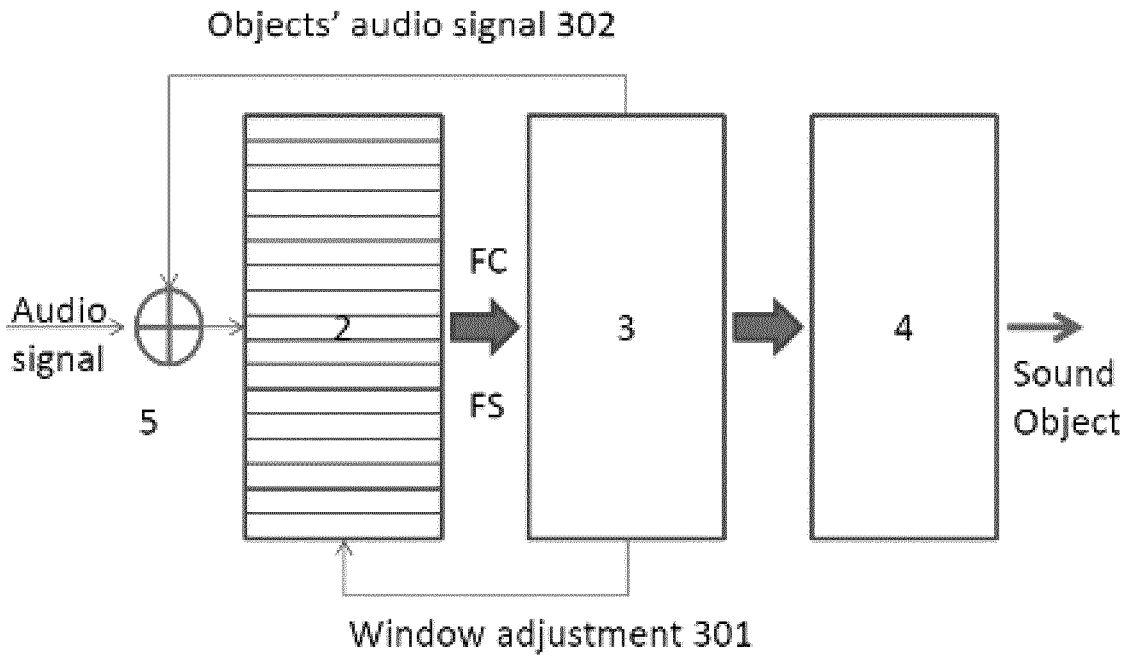
FIG. 1 is a block diagram of a system for decomposition of audio signal into sound objects.

A system 1 for decomposition of acoustic signal into sound objects according to the invention is shown schematically in FIG. 1. An audio signal in digital form is fed to its input. A digital form of said audio signal is obtained as a result of the application of typical and known A/D conversion techniques. The elements used to convert the acoustic signal from analogue to digital form have not been shown herein. The system 1 comprises a filter bank 2 with an output connected to a system for tracking objects 3, which is further connected with a correcting system 4. Between the system for tracking objects 3 and the filter bank there exists a feedback connection, used to control the parameters of the filter bank 2. Furthermore, the system for tracking objects 3 is connected to the input of the filter bank 2 via a differential system 5, which is an integral component of a frequency resolution improvement system 36 in FIG. 8.

Figure 2A:
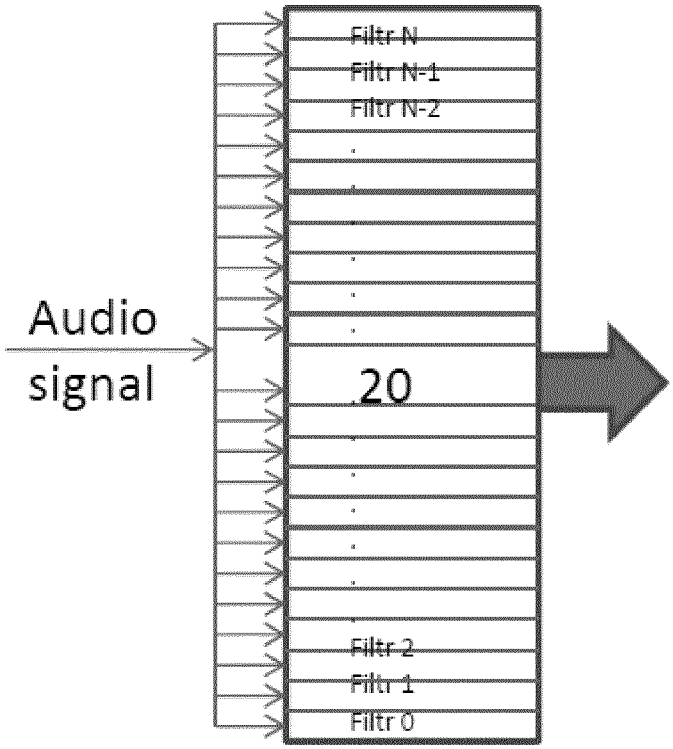
FIG. 2*a* is a parallel structure of a filter bank according to the first embodiment of the invention.
Figure 2B:
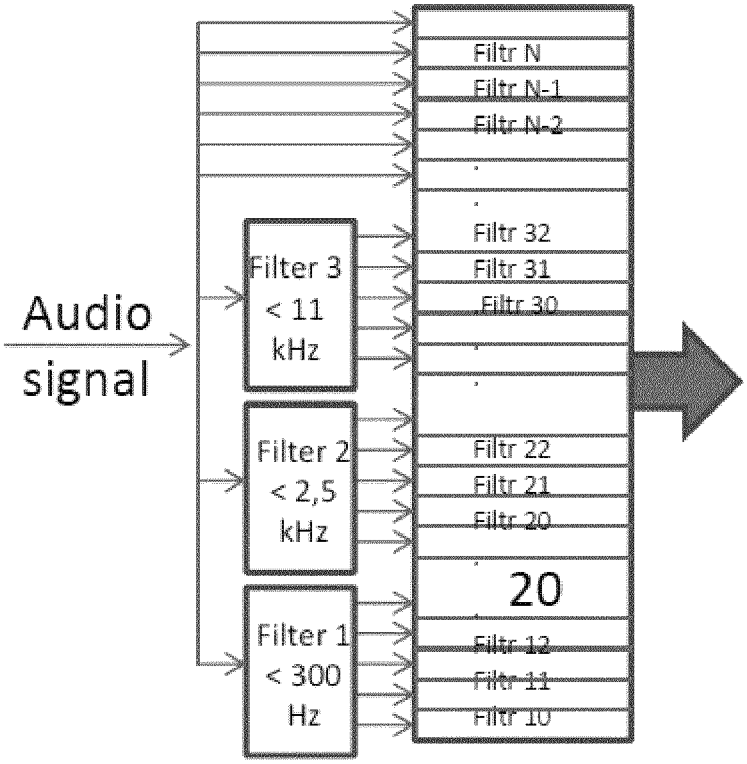
FIG. 2*b* is a tree structure of the filter bank according to the second embodiment of the invention.
Figure 2C:
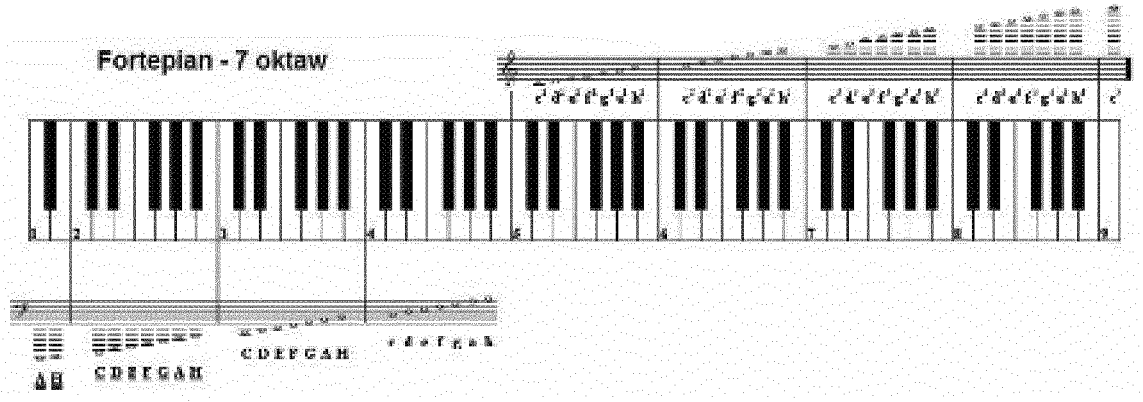
FIG. 2*c* shows the tone spectrum of a piano.
Figure 2D:
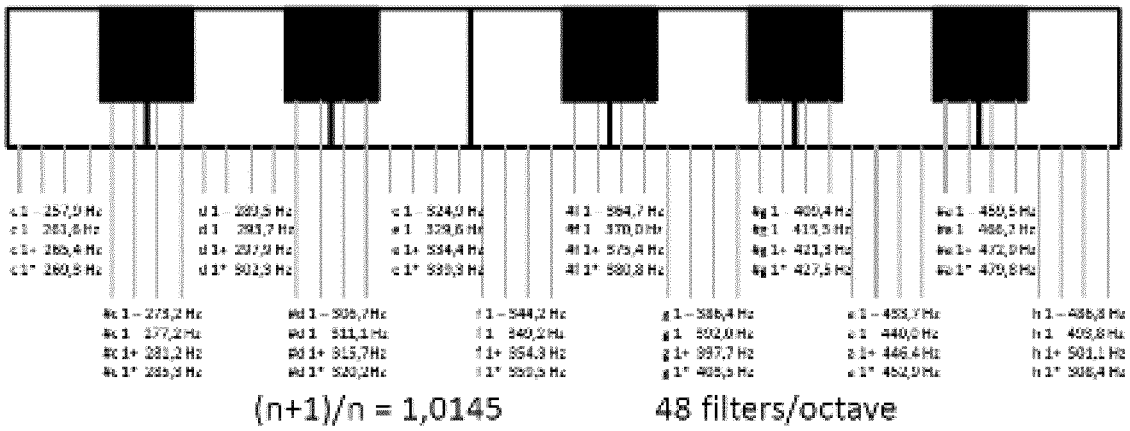
FIG. 2*d* shows an example of a filter structure using 48 filters/octave, i.e. four filters for each semitone.

In order to extract sound objects from an acoustic signal, a time-domain and frequency-domain signal analysis has been used. Said digital input signal is input to the filter bank 2 sample by sample. Preferably, said filters are SOI filters. It is shown in FIG. 2*a* a typical structure of the filter bank 2, in which individual filters 20 process in parallel the same signal with a given sampling rate. Typically, the sampling rate is at least two times higher than the highest expected audio signal's component, preferably 44.1 kHz. Since such a number of samples to be processed per 1 second requires large computational expense, preferably a filter bank tree structure of FIG. 2*b* can be used. In the filter bank tree structure 2 the filters 20 are grouped according to the input signal sampling rate. For example, the splitting in the tree structure can be done at first for the whole octaves. For individual sub-bands with lower frequencies it is possible to cut off high frequency components using a low-pass filter and to sample them with a smaller rate. As a consequence, due to reduction of the number of samples a significant increase in processing speed is achieved. Preferably, for the interval up to 300 Hz the signal is sampled with fp=600 Hz, up to 2.5 kHz with fp=5 kHz.

Since the main task of the method and the system according to the invention is to localize all sound objects in the spectrum, an important issue is possible accuracy of determination of signal's parameters and a resolution of simultaneously appearing sounds. The filter bank should provide a high frequency-domain resolution, i.e. greater than 2 filters per semitone, making it possible to separate two adjacent semitones. In the presented examples 4 filters per semitone are used.

Preferably, in the method and the system according to the invention a scale corresponding to human ear's parameters has been adopted, with logarithmic distribution, however a person skilled in the art will know that other distributions of filters' central frequencies are allowed within the scope of the invention. Preferably, a pattern for the distribution of filters' central frequencies is the musical scale, wherein the subsequent octaves begin with a tone 2 times higher than the previous octave. Each octave is divided into 12 semitones, i.e. the frequency of two adjacent semitones differs by 5.94% (e.g. e1=329.62 Hz, f1=349.20 Hz). To increase accuracy, there are four filters for each semitone in the method and the system according to the invention, wherein each filter listens to its own frequency, differing from an adjacent frequency by 1.45%. It has been assumed that the lowest audible frequency is C2=16.35 Hz. Preferably, the number of filters is greater than 300. A particular number of filters for a given embodiment depends on the sampling rate. With sampling at 22050 samples per second the highest frequency is e6=10548 Hz, 450 filters being in this range. With sampling at 44100 samples per second the highest frequency is e7=21096 Hz, 498 filters being in this range.

Figure 3:
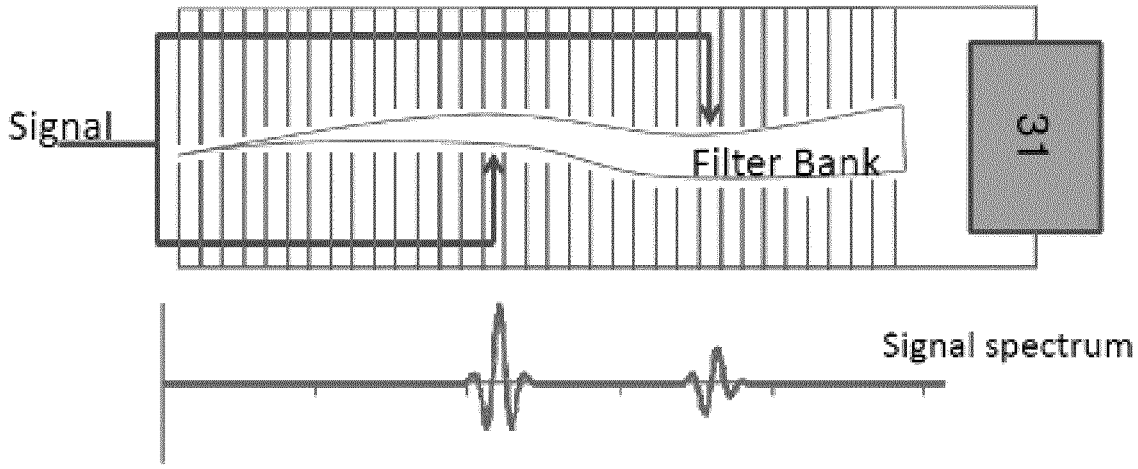
FIG. 3 shows a general principle of operation of a passive filter bank system.

A general principle of operation of a passive filter bank is shown in FIG. 3. The input signal which is fed to each filter 20 of the filter bank 2 is transformed as a result of relevant mathematical operations from the time domain into the frequency domain. In practice, a response to an excitation signal appears at the output of each filter 20, and the signal's spectrum jointly appears at the filter bank's output.

Figure 4:
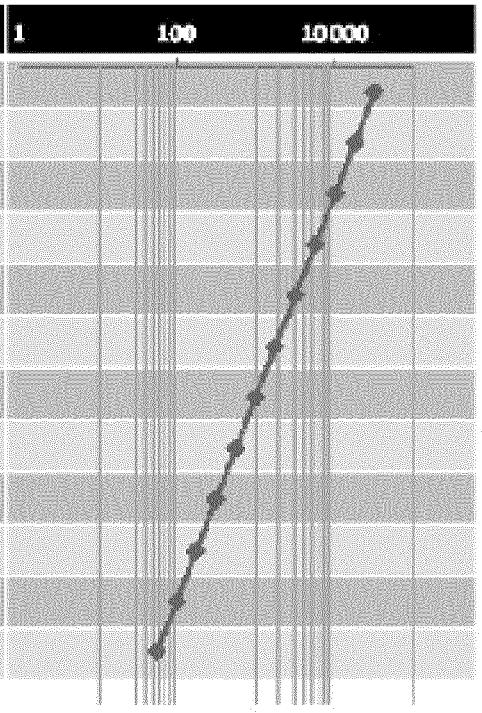
FIG. 4 shows exemplary parameters of filters.

FIG. 4 shows exemplary parameters of selected filters 20 in the filter bank 2. As can be seen in the table, central frequencies correspond to tones to which a particular music note symbol can be attributed. The window width of each filter 20 is given by the relation:

$$W(n)=K*fp/FN(n) \tag{1}$$

where: W(n)—window width of a filter n
fp—sampling rate (e.g. 44100 Hz)
FN(n)—nominal (central) frequency of a filter n
K—window width coefficient (e.g. 16)

Since a higher frequency-domain resolution is necessary in the lower range of the musical scale, therefore for this range of frequencies the filter windows will be the widest. Thanks to an introduction of coefficient K and a normalization to the filter nominal frequency FN there is provided an identical amplitude and phase characteristic for all the filters.

Figure 5:
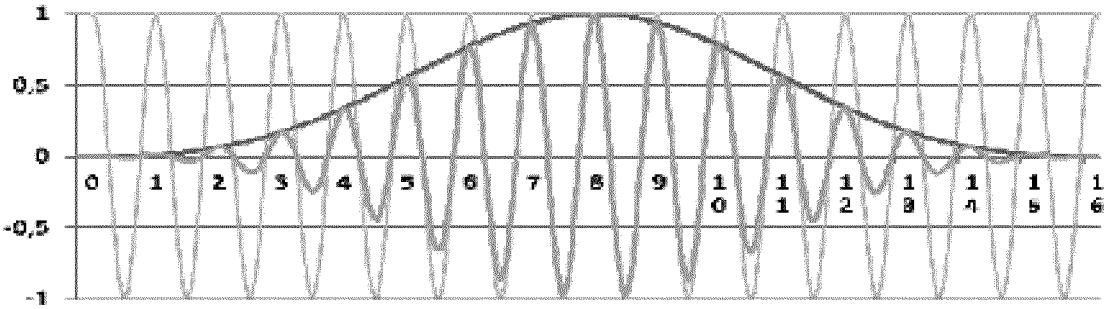
FIG. 5 is the impulse response of a filter F(n) having the Blackman window.

With regard to the implementation of said filter bank—a skilled person will know that one of possible ways of obtaining the coefficients of a SOI type band-pass filter is to determine the impulse response of the filter. An exemplary impulse response of a filter 20 according to the invention is shown in FIG. 5. An impulse response in FIG. 5 is the impulse response of a filter with a cosine window, which is defined by the relation:

$$y(i)(n)=\cos(\omega(n)*i)*A-B*\cos(2\pi i/W(n))+C*\cos(4\pi i/W(n)) \tag{2}$$

where: $\omega(n)=2\pi*FN(n)/fp$
W(n), FN(n), fp—are defined above

| Window type | A | B | C |
|---|---|---|---|
| Hann (Hanning) | 0.5 | 0.5 | 0 |
| Hamming | 0.53836 | 0.46164 | 0 |
| Blackman | 0.42 | 0.5 | 0.08 |

Figure 6:
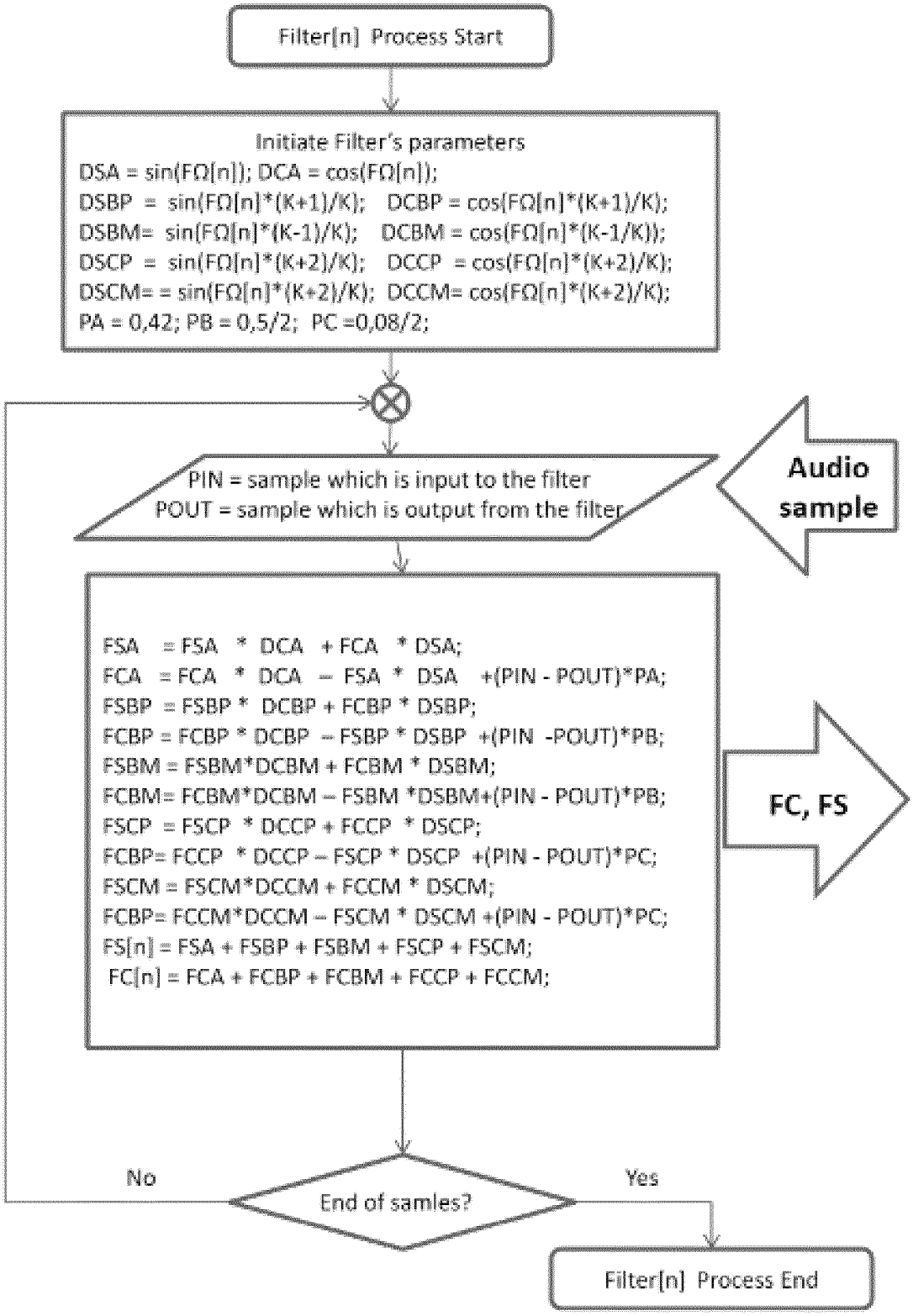
FIG. 6 is a flowchart of a single filter.

The operations performed by each of the filters 20 have been shown in FIG. 6. The task of the filter bank 2 is to enable the determination of an audio signal's frequency spectrum in the range of frequencies from the lowest audible by human (e.g. C2=16.35 Hz) to ½ fp—sampling rate (e.g. e7=21096 Hz at 44100 samples per second). Before each filter begins its operation, parameters of the filter 20 are initiated, the exemplary parameters being the coefficients of particular components of time window function. Then, the current sample $P_{IN}$ of the input signal, having only a real value, is fed to the input of the filter bank 2. Each filter 2, using a recursive algorithm, calculates a new value of components FC(n) and FS(n) based on the previous values of the real component FC(n) and the imaginary component FS(n), and calculates also values of the sample $P_{IN}$ input to the filter and the sample $P_{OUT}$ leaving the filter's window and which is stored in an internal shift register. Thanks to the use of a recursive algorithm the number of calculations for each of the filters is constant and does not depend on the filter's window length. The executed operations for a cosine window are defined by the formula:

$$FC(n) = \sum_{i=-W(n)}^{0} y_1 * \cos(\omega(n) * i) * \left(A - B * \cos\left(\frac{2\pi i}{W(n)}\right)\right) + C * \cos\left(\frac{4\pi i}{W(n)}\right) \quad (3)$$

$$FS(n) = \sum_{i=-W(n)}^{0} y_1 * \sin(\omega(n) * i) * \left(A - B * \cos\left(\frac{2\pi i}{W(n)}\right)\right) + C * \cos\left(\frac{4\pi i}{W(n)}\right) \quad (4)$$

By using trigonometric equations relating to products of trigonometric functions for equations (3) and (4) one obtains a dependence of the components FC(n) and FS(n) on the values of these components for the previous sample of the audio signal and a value of the sample inputted to the filter $P_{IN}$, and the one outputted from the filter $P_{OUT}$, according to the equation shown in FIG. 6. In the case of each filter 20 the calculation of the equation for each subsequent sample requires 15 multiplications and 17 additions for Hann or Hamming type windows, or 25 multiplications and 24 additions for a Blackman window. The process of the filter 20 is finished when there are no more audio signal samples at the filter's input.

Figure 7A:
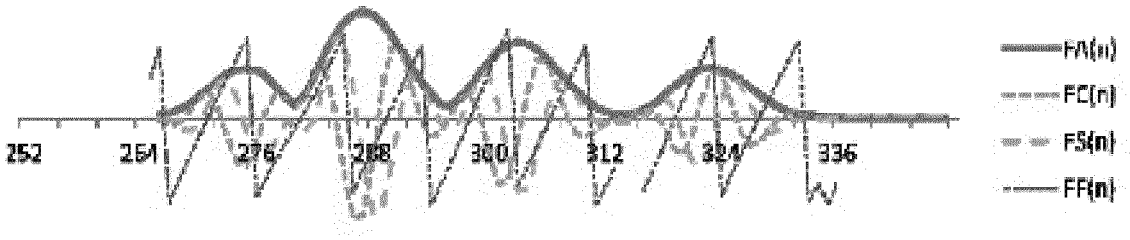
FIGS. 7*a* and 7*c* show a part of a spectrum of the filter bank output signal, comprising the real component FC(n), the imaginary component FS(n) and the resulting amplitude of the spectrum FA(n) and the phase FF(n)
Figure 7B:
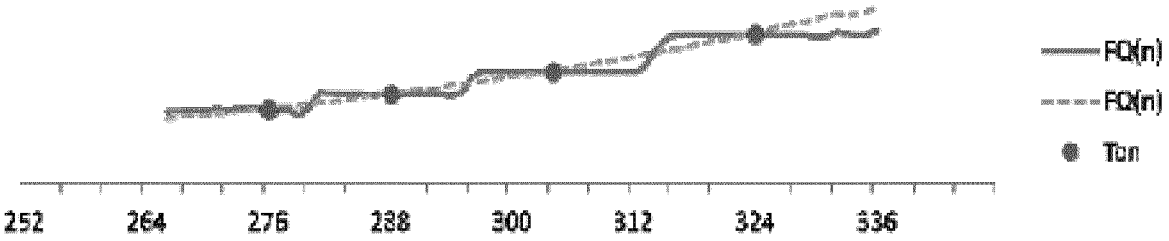
FIGS. 7*b* and 7*d* show the nominal angular frequency F #(n) of a corresponding filter group and angular frequency of the spectrum FQ(n).
Figure 7C:
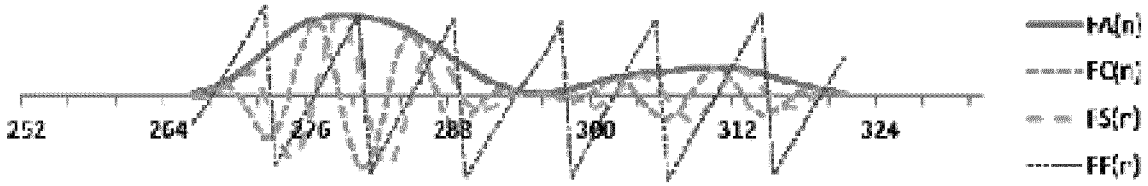
Figure 7D:
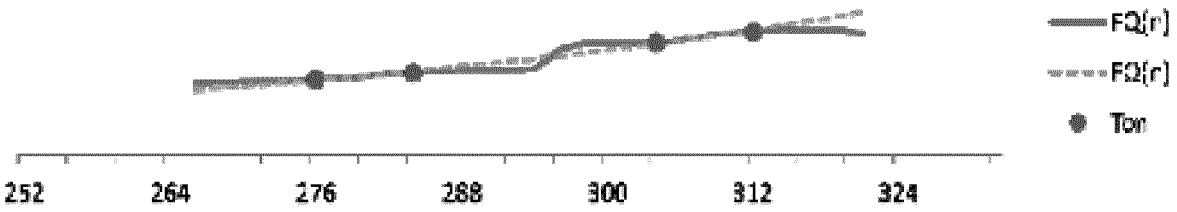
Figure 8:
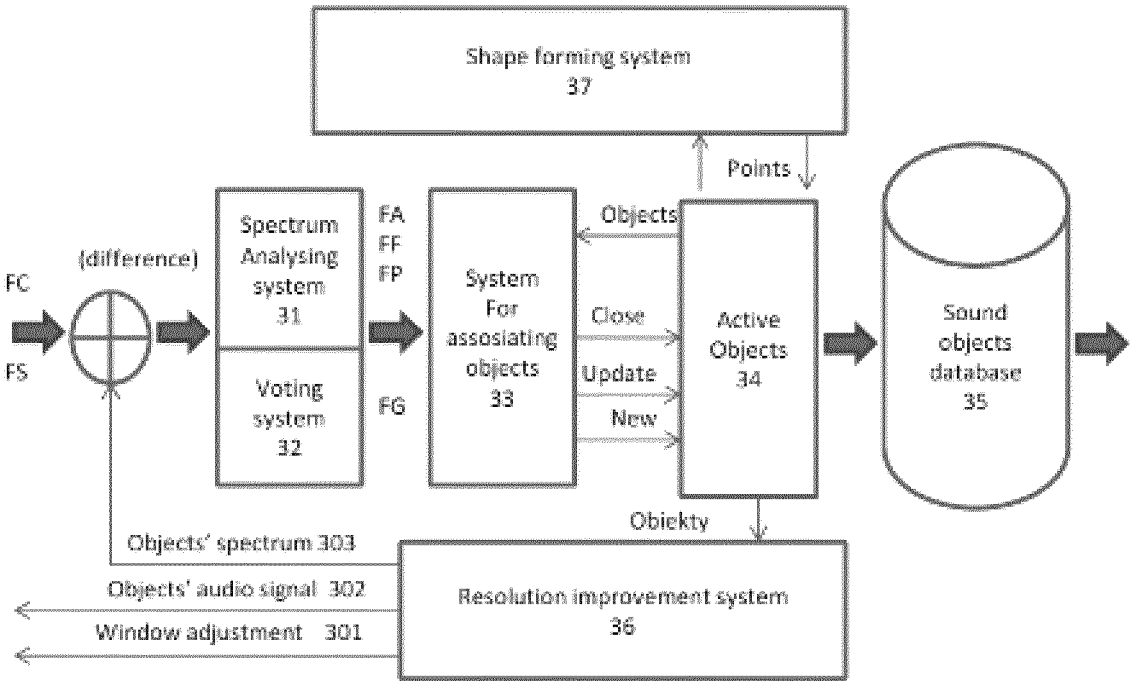
FIG. 8 is a block diagram of a system for tracking sound objects.
Figure 8A:
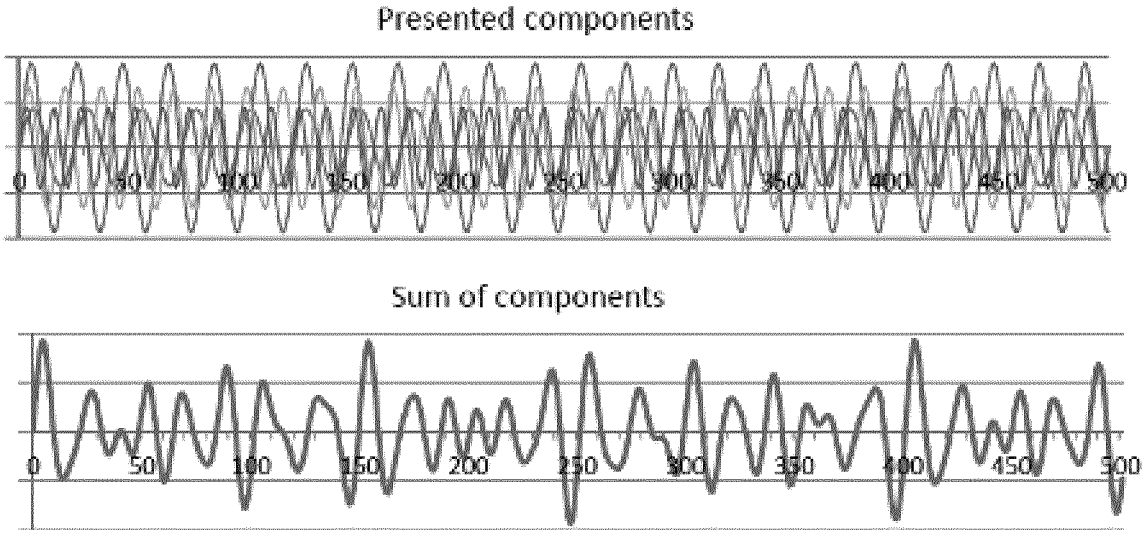
FIG. 8*a* shows a relationship between four individual frequency components and their sum.
Figure 8B:
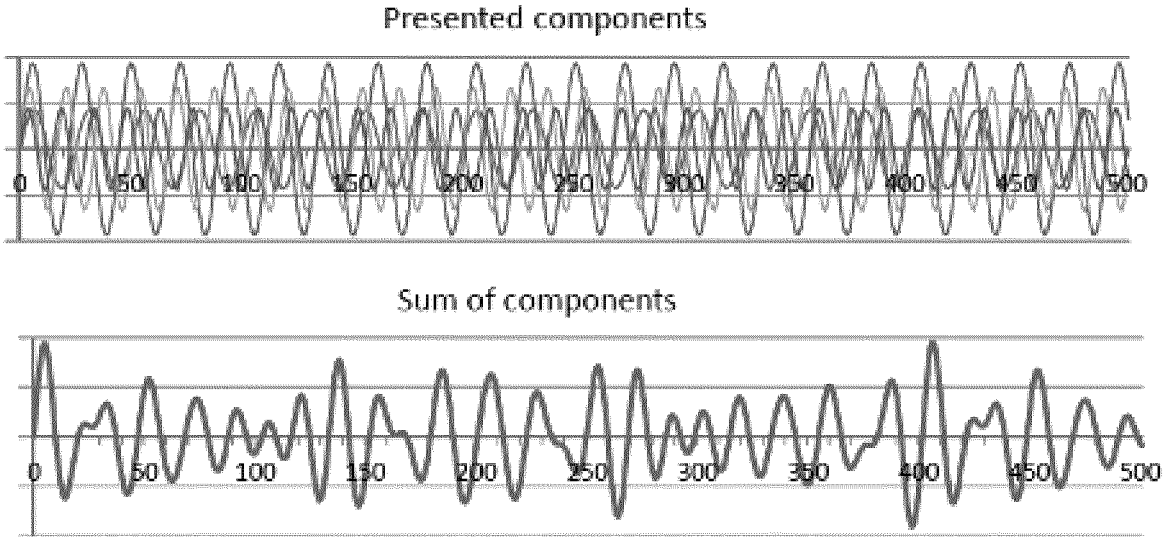
FIG. 8*b* shows another example of a signal having four different frequency components (tones)

Values of the real component FC(n) and the imaginary component FS(n) of the sample obtained after each subsequent sample of the input signal are forwarded from each filter's 20 output to a system for tracking sound objects 3, and in particular to a spectrum analyzing system 31 comprised therein (as shown in FIG. 8). Because the spectrum of the filter bank 2 is calculated after each sample of the input signal, the spectrum analyzing system 31 except of the amplitude characteristic can utilize the phase characteristic at the filter bank's 2 output. In particular, in the method and the system according to the invention the change of phase of the current sample of the output signal in relation to the phase for the previous sample is used for precise separation of the frequencies present in the spectrum, what will be described further with reference to FIGS. 7*a*, 7*b*, 7*c* and 7*d*, and FIG. 8.

A spectrum analyzing system 31, being a component of the system for tracking objects 3 (as shown in FIG. 8) calculates individual components of the signal's spectrum at the filter bank output. To illustrate the operation of this system, an acoustic signal with the following components has been subjected to analysis:

| Tone No. | FN | Note |
|---|---|---|
| 276 | 880.0 Hz | a2 |
| 288 | 1046 Hz | c3 |
| 304 | 1318 Hz | e3 |
| 324 | 1760 Hz | a3 |

There are shown in FIGS. 7*a* and 7*b* plots of instantaneous values of quantities obtained at the output of selected group of filters 20 for said signal and values of quantities calculated and analyzed by the spectrum analyzing system 31. For filters with number n from 266 to 336 with a window having the window width coefficient K=16 there have been represented: the instantaneous value of the real component FC[n], the instantaneous value of the imaginary component FS[n], which are fed to the input of the spectrum analysis system 31, and the instantaneous value of the spectrum's amplitude FA[n] and the spectrum's phase FF[n], which are calculated by the spectrum analyzing system 31. As already mentioned, the spectrum analyzing system 31 collects all the possible information necessary to determine the actual frequency of the sound objects present at a given time instant in the signal, including the information about the angular frequency. The correct location of the tone of component frequencies has been shown in FIG. 7*b*, and it is at the intersection of the nominal angular frequency of the filters FQ[n] and the value of the angular frequency at the output of the filters FQ[n], calculated as a derivative of the phase of the spectrum at the output of a particular filter n. Thus, according to the invention, in order to detect a sound object, the spectrum analyzing system 31 analyses also the plot of angular frequency F#[n] and FQ[n]. In the case of a signal comprising components which are distant from each other, points which are determined as a result of analysis of the angular frequency correspond to locations of maxima of the amplitude in FIG. 7*a*.

Due to some typical phenomena in the signal processing domain basing only on maxima of amplitude of the spectrum is not effective. The presence of a given tone in the input signal affects the value of the amplitude spectrum at adjacent frequencies, leading in consequence to a severely distorted spectrum when the signal comprises two tones close to each other. To illustrate this phenomenon, and to illustrate the functionality of the spectrum analyzing system 31 according to the invention, a signal has been subjected also to the analysis, comprising sounds of frequencies:

| Tone No. | FN | Note |
|---|---|---|
| 276 | 880.0 Hz | a2 |
| 284 | 987.8 Hz | h2 |
| 304 | 1318 Hz | e3 |
| 312 | 1480 Hz | #f3 |

As shown in FIGS. 7*c* and 7*d*, in the case of a signal with closely located components, the correct location of a tone determined based on the analysis of angular frequency plots does not correspond to the maximum of amplitude in FIG. 7*c*. Thus, for such a case, thanks to various parameters analyzed by the spectrum analyzing system 31 it is possible to detect situations which are critical for decomposition of an acoustic signal. In consequence, it is possible to apply specific procedures leading to correct recognition of components, what will be described further with reference to FIG. 8 and FIG. 9*a*, and FIG. 9*b*.

The fundamental task of the system for tracking objects 3, a block diagram of which is shown in FIG. 8, is to detect at a given time instant all frequency components present in an input signal. As shown in FIG. 7*b* and FIG. 7*d*, the filters adjacent to the input tone have very similar angular frequencies, different from the nominal angular frequencies of those filters. This property is used by another subsystem of the system for tracking objects 3, namely the voting system 32.

To prevent incorrect detection of frequency components, the values of the amplitude spectrum FA(n) and angular frequency at the output of filters FQ(n), calculated by the spectrum analyzing system 31, are forwarded to the voting system 32 for calculation of their weighted value and detection of its maxima in function of the filter's number(n). In this way, one obtains a voting system, which takes into account the frequency at the outputs of all the filters 20 adjacent to it in order to determine frequencies present in the input signal for a given frequency at the filter's 2 output. The operation of this system is shown in FIGS. 9*a* and 9*b*. FIG. 9*a* illustrates a relevant case shown in FIGS. 7*a* and 7*b*, while FIG. 9*b* illustrates a relevant case shown in FIGS. 7*c* and 7*d*. As it can be seen, the plot of the signal FG(n) (the weighted value calculated by the voting system 32) has distinct peaks in locations corresponding to tones of frequency components present in the input signal. In the case of an input signal comprising components distinctly separated from each other (as shown in FIG. 9*a*) these locations correspond to a maximum of amplitude of the spectrum FA(n). In the case of a signal comprising components situated too close to each other (as shown in FIG. 9*b*), without the voting system 32 tones reflected in maximum of amplitude of the spectrum would have been detected, which are located in places other than the mentioned peaks in the weighted signal FG(n).

Figure 10:
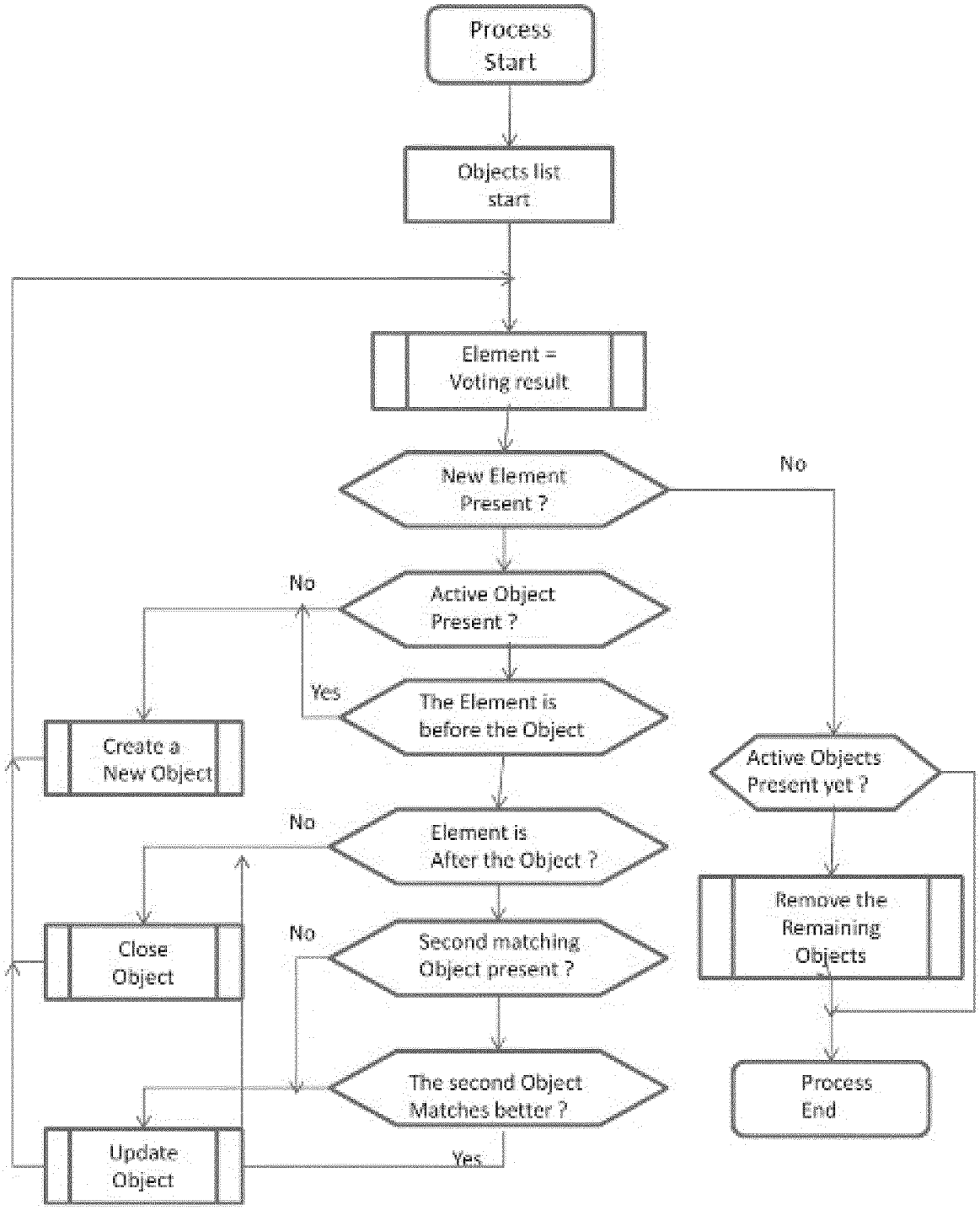
FIG. 10 is a flowchart of a sound system for associating objects.
Figure 10A:
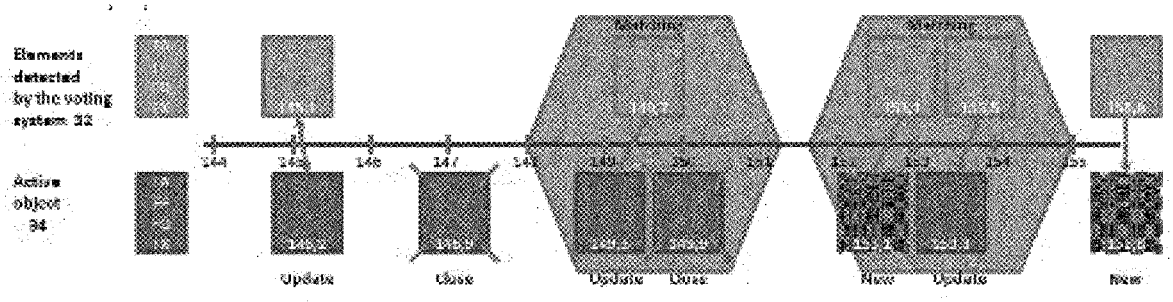
FIG. 10*a* is an illustration of the element detection and object creation process according to an embodiment of the invention.
Figure 10B:
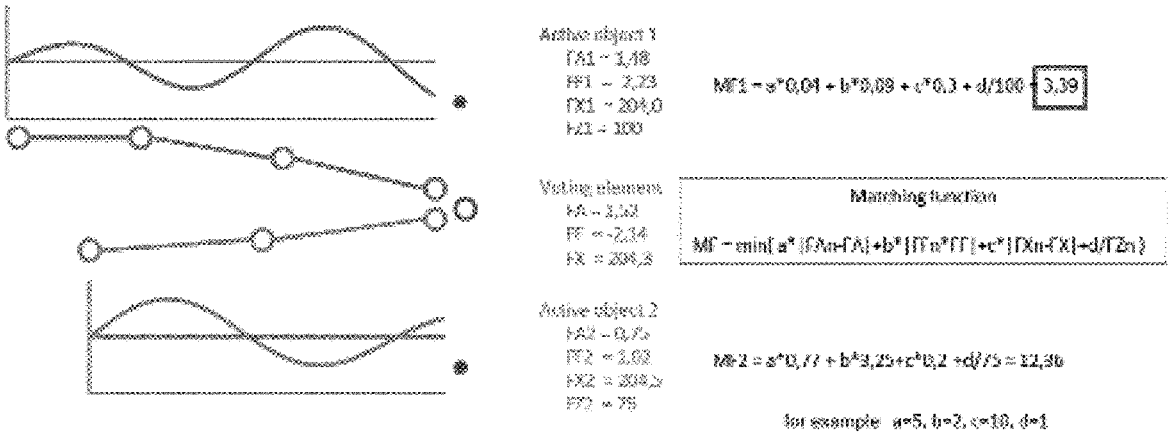
FIG. 10*b* illustrates the application of a matching function according to an embodiment of the invention.

In other words, said 'voting system' performs an operation of 'calculating votes', namely an operation of collecting 'votes' of each filter(n) on a specific nominal angular frequency which 'votes' by outputting its angular frequency close to the one on which said 'vote' is given. Said 'votes' are shown as a curved line FQ[n]. An exemplary implementation of said voting system 32 could be a register into which certain calculated values are collected under specific cell. The consecutive number of filter, namely the number of a cell in the register under which a certain value should be collected would be determined based on specific angular frequency outputted by a specific filter, said outputted angular frequency being an index to the register. The person skilled in the art will know that the value of outputted angular frequency is rarely an integer thus said index should be determined based on certain assumption, for example that said value of instant angular frequency should be round up or round down. Next the value to be collected under a determined index can be for example a value equal to 1 multiplied by the amplitude outputted by said voting filter or a value equal to a difference between the outputted angular frequency and the closest nominal frequency multiplied by the amplitude outputted by said voting filter. Such values can be collected in a consecutive cell of the register by addition or subtraction or multiplication or by any other mathematical operation reflecting the number of voting filters. In this way the voting system 31 calculates a 'weighted value' for a specific nominal frequency based on parameters acquired from the spectrum analyzing system. This operation of 'calculating votes' takes into account three sets of input values, the first one being values of nominal angular frequencies of filters, the second one being values of instant angular frequencies of filters, third ones being values of the amplitude spectrum FA(n) for each filter As is shown in FIG. 8, the spectrum analyzing system 31 and the voting system 32 are connected at their output with a system for associating objects 33. Having at its disposal the list of frequencies detected by the voting system 32 which composes the input signal, and additional parameters, such as amplitude, phase and angular frequency associated to each detected frequency, the system for associating objects 33 combines these parameters in "elements" and next builds sound objects out of them. Preferably, in the system and the method according to the invention, the frequencies (angular frequencies) detected by the voting system 32, and thus "elements", are identified by the filter number n. The system for associating objects 33 is connected to an active objects database 34. The active objects database 34 comprises objects arranged in order depending on the frequency value, wherein the objects have not yet been "terminated". The term "a terminated object" is to be understood as an object such that at a given time instant no element detected by the spectrum analyzing system 31 and the voting system 32 can be associated with it. The operation of the system for associating objects 33 has been shown in FIG. 10. Subsequent elements of the input signal detected by the voting system 32 are associated with selected active objects in the database 34. To limit the number of required operations, preferably, detected objects of a given frequency are compared only with the corresponding active objects located in a predefined frequency range. At first, the comparison takes into account the angular frequency of an element and an active object. If there is no object sufficiently close to said element (e.g. in the range of distances in frequency corresponding to 0.2 tone) this means that a new object has appeared and it should be added to the active objects 34. If, once associating objects with current elements has been finished, there is no element sufficiently close for an active sound object (e.g. in the range of distances in frequency corresponding to 0.2 tone) this means that no further parameters for the object are detected and it should be terminated. Said terminated object is taken into account in the association process still for 1 period of its frequency to avoid an accidental termination caused by a temporary interference. During this time it can return to active sound objects in the database 34. After 1 period the object's final point is determined. If the object lasted for a sufficiently long time (e.g. its length was not shorter than the width of the corresponding window W[n]), then this object is transferred to a sound objects database 35.

In the case of associating with each other an active object and an object sufficiently close to, a matching function is further calculated in the system for associating objects 33, which comprises the following weighted values: amplitude matching, phase matching, objects duration time. Such a functionality of the system for associating objects 33 according to the invention is of essential importance in the situation when in a real input signal a component signal from one and the same source has changed frequency. This is because it happens that as a result of frequency changing a number of active objects become closer to each other. Therefore, after calculating the matching function the system for associating objects 33 checks if at a given time instant there is a second object sufficiently close to in the database 34. The system 33 decides which object will be a continuer of the objects which join together. The selection is decided by the result of the matching function comparison. The best matched active object will be continued, and an instruction to terminate will be issued for the remaining ones. Also a resolution improvement system 36 cooperates with the active objects database 34. It tracks the mutual frequency-domain distance of the objects present in the signal. If too close frequencies of active objects are detected the resolution improvement system 36 sends a control signal to start one of the three processes improving the frequency-domain resolution. As mentioned previously, in the case of presence of a few frequencies close to each other, their spectrum overlap. To distinguish them the system has to "listen intently" to the sound. It can achieve this by elongating the window in which the filter samples the signal. In this situation a window adjustment signal 301 is activated, informing the filter bank 2 that in the given range the windows should be elongated. Due to the window elongation the signal dynamics analysis is impeded, therefore if no close objects are detected the resolution improvement system 36 enforces a next shortening of the filter's 20 window.

In the solution according to the invention a window with length of 12 to 24 periods of nominal frequency of the filter 20 is assumed. The relation of the frequency-domain resolution with the window's width is shown in FIG. 11. The table below illustrates the ability of the system to detect and track at least 4 non-damaged objects subsequently present next to each other, with the minimal distance expressed in percentage, as a function of the window's width.

| Window width (in periods) | Detects objects in the distance of | Tracks objects in the distance of |
|---|---|---|
| 12 | 17.4% | 23.2% |
| 16 | 14.5% | 17.4% |
| 20 | 8.7% | 14.5% |
| 24 | 5.9% | 11.6% |

In another embodiment the system "listens intently" to a sound by modifying the filter bank's spectrum, what is schematically illustrated in FIG. 12. The frequency-domain resolution is improved by subtracting from a spectrum at the tracking system's 3 input the expected spectrum of "well localized objects", which are localized in vicinity of new appearing objects. "Well localized objects" are considered as objects the amplitude of which does not vary too quickly (no more than one extreme per window's width) and the frequency of which does not drift too quickly (no more than 10% variation of frequency per window's width). An attempt to subtract a spectrum of objects varying quicker can lead to the phase inversion at the measurement system input and to a positive feedback resulting in generation of an interfering signal. In practice the resolution improvement system 36 calculates the expected spectrum 303 based on the known instantaneous frequency, amplitude and phase of an object by the following formula:

$$FS(n)=FA(n)*\exp(=(x-FX(n)/2/2\sigma2(W(n)))*\sin(FD(n)*(x-FX(n))+FF(n))$$

$$FC(n)=FA(n)*\exp(-(x-FX(n))2/2\sigma2(W(n)))*\cos(FD(n)*(x-FX(n))+FF(n))$$

where σ It is a function of the width of the window when width of the window=20 then σ2=10, i.e. based on the known instantaneous frequency and subtracts them from the real spectrum, causing that the spectrum of adjacent elements will not be interfered so strongly. The spectrum analyzing system 31 and the voting system 32 perceive only adjacent elements and a variation of the subtracted object. However, the system for associating objects 33 further takes into account the subtracted parameters while comparing the detected elements with the active objects database 34. Unfortunately, to implement this frequency-domain resolution improvement method a very large number of computations is required and a risk of positive feedback exists.

Figure 13:
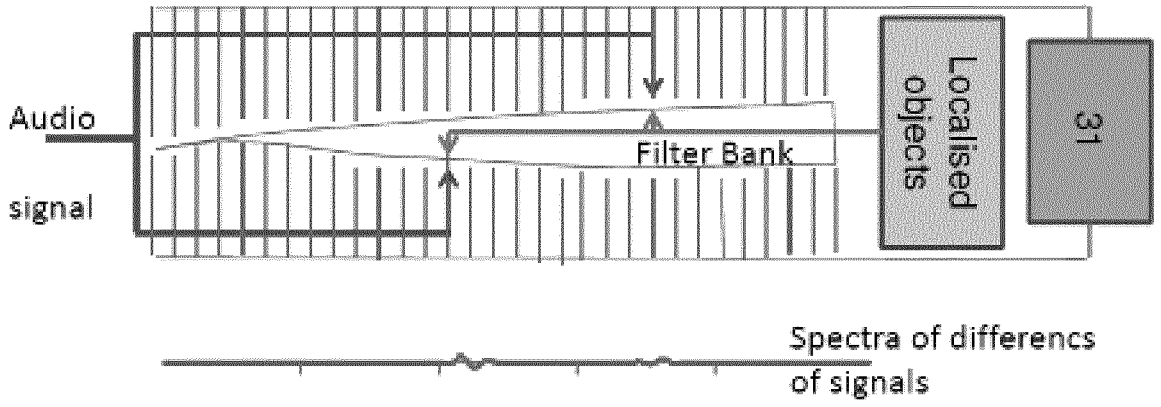
FIG. 13 shows the operation of a frequency resolution improvement system according to yet another embodiment.

In a yet another embodiment, the frequency-domain resolution can be improved by subtracting from the input signal an audio signal generated based on well localized (like in the previous embodiment) adjacent objects. Such operation is shown schematically in FIG. 13. In practice, this relies on the fact that the resolution improvement system 36 generates an audio signal 302 based on information about frequency, amplitude and phase of the active objects 34, which is forwarded to a differential system 5 at the filter bank's 2 input, as shown schematically in FIG. 13. The number of required calculations in an operation of this type is smaller than in the case of the embodiment in FIG. 12, however due to an additional delay introduced by the filter bank 2 the risk of system's instability and unintended generation increases. Similarly, also in this case the system for associating objects 33 takes into account the parameters of the subtracted active objects. Due to mechanisms which have been described the method and the system according to the invention provide the frequency-domain resolution of at least ½ semitone (i.e. FN[n+1]/FN[n]=102.93%)

Figure 14A:
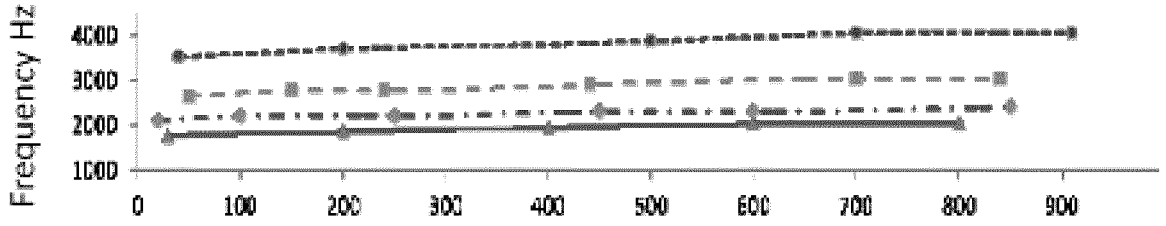
FIGS. 14*a*, 14*b*, 14*c*, 14*d* show examples of representation of sound objects.
Figure 14B:
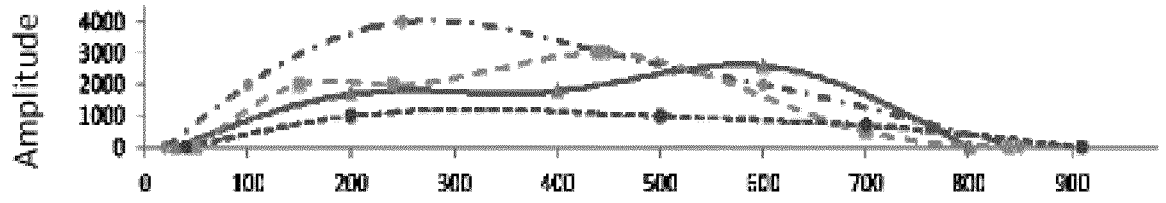
Figures 14C, 14D:
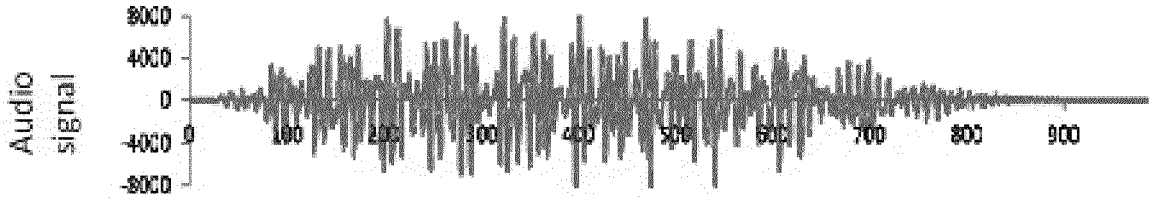
Figure 14E:
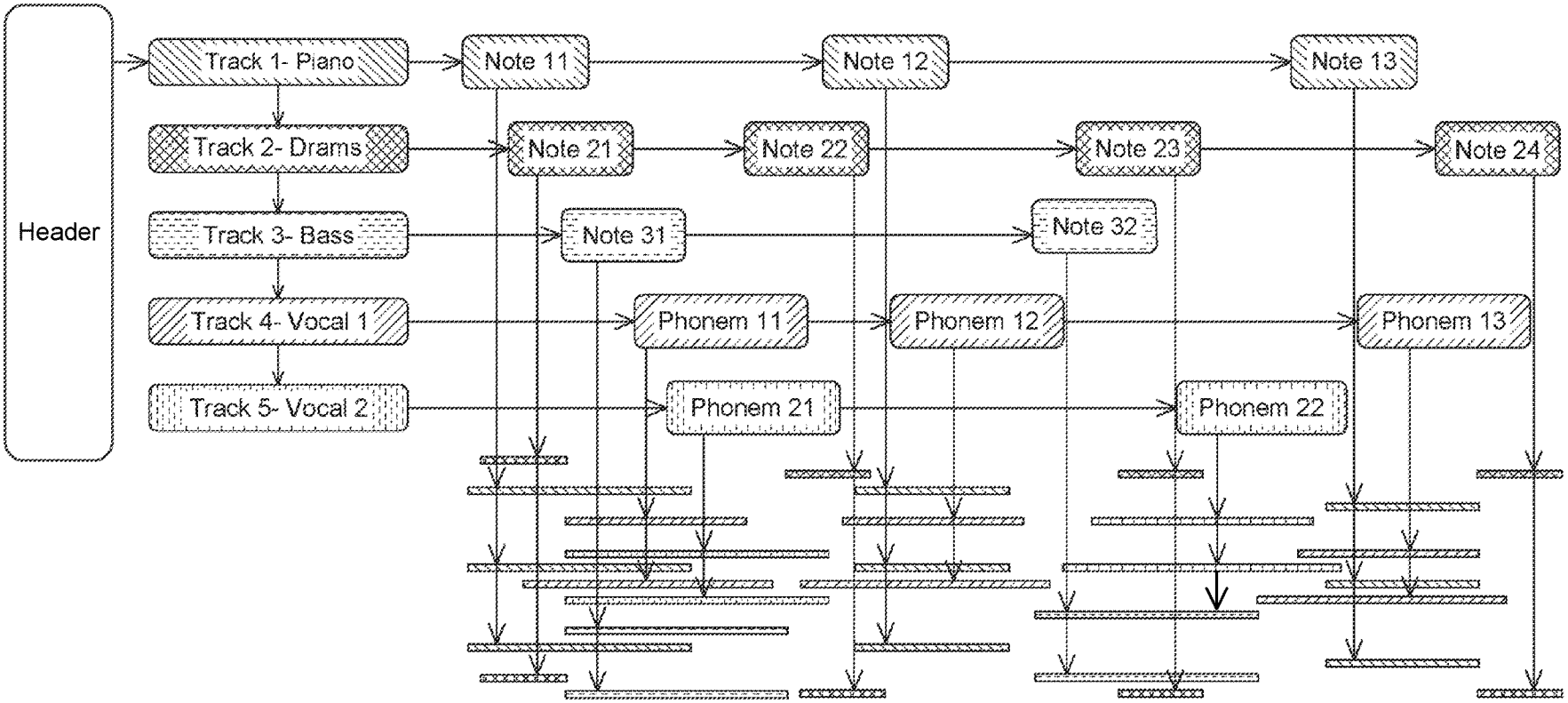
FIG. 14*e* shows an example of a multi-level description of an audio signal according to an embodiment of the invention.

According to the invention, the information contained in the active objects database 34 is also used by a shape forming system 37. The expected result of the sound signal decomposition according to the invention is to obtain sound objects having the form of sinusoidal waveforms with slowly-varying amplitude envelope and frequency. Therefore, the shape forming system 37 tracks variations of the amplitude envelope and frequency of the active objects in the database 34 and calculates online subsequent characteristic points of amplitude and frequency, which are the local maximum, local minimum and inflection points. Such information allows to unambiguously describe sinusoidal waveforms. The shape forming system 37 forwards these characteristic information in the form of points describing an object online to the active objects database 34. It has been assumed that the distance between points to be determined should be no less than 20 periods of the object's frequency. Distances between points, which are proportional to frequency, are capable to effectively represent dynamics of the objects' variation. Exemplary sound objects have been shown in FIG. 14*a*. This figure illustrates four objects with frequency varying in function of time (sample number). The same objects have been shown in FIG. 14*b* in the space defined by amplitude and time (sample number). The illustrated points indicate local maxima and minima of the amplitude. The points are connected by a smooth curve, calculated with the use of third order polynomials. Having determined the function of frequency variation and the amplitude envelope it is possible to determine the audio signal. FIG. 14*c* illustrates an audio signal determined based on the shape of the objects defined in FIG. 14*a* and FIG. 14*b*. The object shown in the plots have been described in the form of the table FIG. 14*d*, wherein for each object there are described the parameters of its subsequent characteristic points, including the first point, the last point and the local extrema. Each point has three coordinates, i.e. the position in time expressed by the sample number, the amplitude and the frequency. Such set of points describes unambiguously a slowly-varying sinusoidal waveform FIG. 14*e* shows an example of a multi-level description of an audio signal according to an embodiment of the invention. As shown in FIG. 14*e*, a header refers to five (5) channels or tracks, namely three instrumental tracks: "Track 1," "Track 2," "Track 3," and two vocal tracks: "Track 4," and "Track 5." The instrumental track "Track 1" comprises three sound objects: "Note 11,", "Note 12," and "Note 13." The instrumental track "Track 2" comprises four sound objects: "Note 21," "Note 22," "Note 23," and "Note 24." The track instrumental "Track 3" comprises two sound objects: "Note 31" and "Note 32." The vocal track "Track 4—Vocal" comprises three sound objects: "Phonem 11,"

"Phonem 12," and "Phonem 13." The vocal track "Track 5—Vocal" comprises two sound objects: "Phonem 21" and "Phonem 22."

Figure 15A:
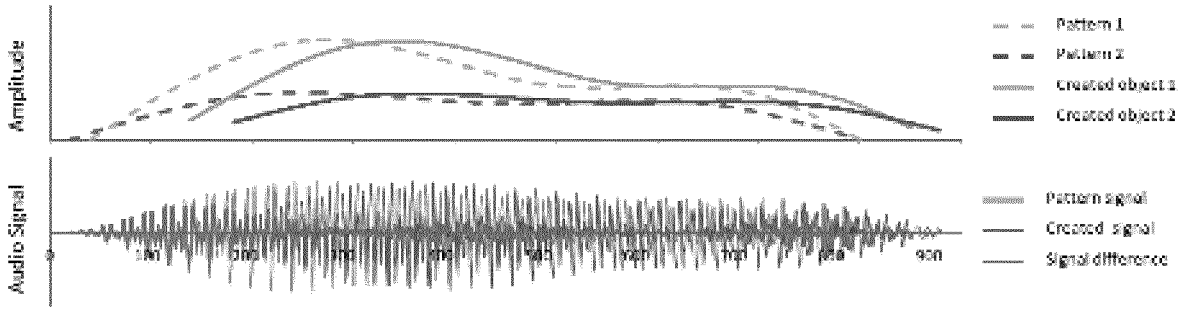
FIG. 15*a* shows an audio signal composed of two frequencies (dashed lines) and a signal obtained from the decomposition, without correction.

The description of sound objects shown in the table FIG. 14*d* can be written down in the form of a formalized protocol. Standardization of such notation will allow to develop applications using the properties of the sound objects according to the invention. FIG. 15 shows an exemplary format of sound objects notation.

1) Header: The notation starts with a header having as an essential element a header tag comprising a four byte keyword, informing that we deal with the description of sound objects. Next, in two bytes an information about the number of channels (tracks) is specified and two bytes of time unit definition. The header occurs only once at the beginning of a file.

2) Channel: Information about channels (tracks) from this field serves to separate the group of sound objects being in an essential relation, e.g. left or right channel in stereo, vocal track, percussion instruments track, recording from a defined microphone etc. The channel field comprises the channel identifier (number), the number of objects in the channel and the position of the channel from the beginning of an audio signal, measured in defined units.

3) Object: An identifier contained in the first byte decides about the type of the object decides. Identifier "0" denotes a basic unit in the signal record which is the sound object. Value "1" can denote a folder containing a group of objects like, for example, basic tone and its harmonics. Other values can be used to define other elements related to objects. The description of the fundamental sound object includes the number of points. The number of points does not include the first point, which is defined by the object itself. Specifying maximal amplitude in object's parameters allows to control simultaneous amplification of all points of the object. In the case of a folder of objects, this affects the value of amplitude of all the objects contained in the folder. Analogically, specifying information about frequency (applying notation: number of tone*4 of a filter bank=notes*16) allows to simultaneously control the frequency of all the elements related to an object. Furthermore, defining the position of the beginning of an object in relation to a higher level element (e.g. a channel) allows to shift the object in time.

4) Point: Points are used to describe the shape of the sound object in time-frequency-amplitude domain. They have relative value with respect to parameters defined by the sound object. One byte of amplitude defines which part of the maximal amplitude defined by the object the point has. Similarly, tone variation defines by what fraction of tone the frequency has changed. Position of point is defined as relative with respect to the previously defined point in the object.

The multilevel structure of recording and relative associations between the fields allow a very flexible operation on sound objects, making them effective tools for designing and modifying audio signals.

Condensed recording of information about sound objects according to the invention, in the format shown in FIG. 15, greatly affects in a positive way the size of registered and transferred files. Taking into account that an audio file can be readily played from this format, we can compare the size of the file shown in FIG. 14*c*, which in .WAV format would contain over 2000 bytes, and in the form of sound objects record "UHO" according to the invention, it would contain 132 bytes. A compression better than 15-fold is not an excellent achievement in this case. In the case of longer audio signals much better results can be achieved. The compression level depends on how much information is contained in the audio signal, i.e. how many and how composed objects can be read from the signal.

Identification of sound objects in an audio signal is not an unambiguous mathematical transformation. The audio signal created as a composition of objects obtained in the result of a decomposition differs from the input signal. The task of the system and the method according to the invention is to minimize this difference. Sources of differences are of two types. Part of them is expected and results from the applied technology, other can result from interference or unexpected properties of input audio signal. To reduce the difference between the audio signal composed of sound objects according to the invention and the input signal a correcting system 4, shown in FIG. 1, is used. The system takes parameters of objects from the sound objects database 35 already after terminating the object and performs the operation of modification of selected parameters of objects and points such as to minimize the expected differences or irregularities localized in these parameters.

Figure 16:
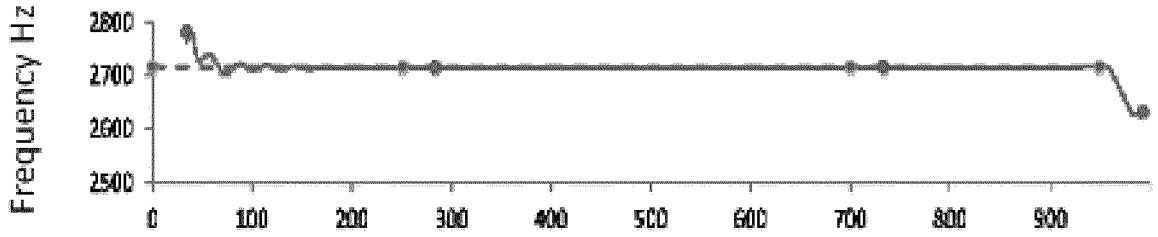
FIG. 16 shows a first example of a sound object requiring correction.

The first type of correction of sound objects according to the invention, performed by the correcting system 4, is shown in FIG. 16. The distortion at the beginning and at the end of the object is caused by the fact that during transient states, when the signal with defined frequency appears or fades, filters with a shorter impulse response react to the change quicker. Therefore, at the beginning the object is bent in the direction of higher frequencies, and at the end it turns towards the lower frequencies. Correction of an object can be based on deforming the object's frequency at the beginning and at the end in the direction defined by the middle section of the object.

Figure 17:
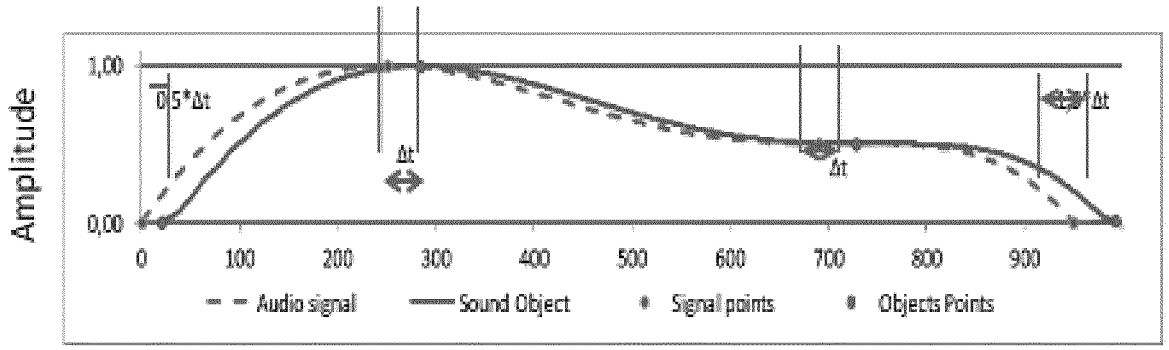
FIG. 17 shows a second example of a sound object requiring correction.

A further type of correction according to the invention, performed by the correcting system 4, has been shown in FIG. 17. The audio signal samples passing through a filter 20 of the filter bank 2 cause a change at the filter's output, which manifests as a signal shift. This shift has a regular character and is possible to be predicted. Its magnitude depends on the width of the window K of the filter n, the width being in accordance to the invention a function of frequency. This means that each frequency is shifted by a different value, what affects the sound of the signal perceivably. The magnitude of the shift is ca. ½ filter window's width in the area of normal operation of the filter, ¼ window's width in the initial phase and ca. ¾ window's width in the case of the objects end. Because for each frequency the magnitude of the shift can be predicted, the task of the correcting system 4 is to properly shift all the points of the object in the opposite direction, so that the dynamics of the representation of the input signal improves.

Figure 18A:
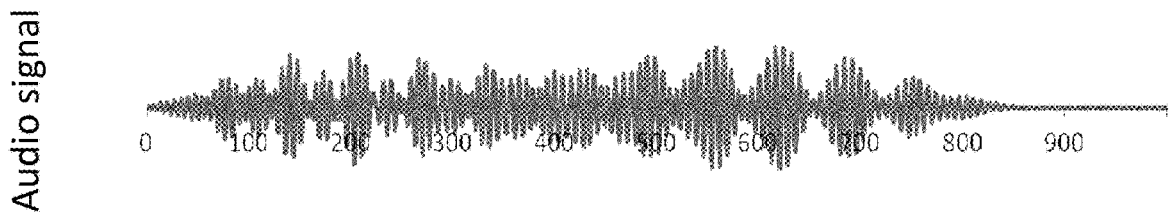
FIGS. 18*a* to 18*c* show further examples of sound objects requiring correction.
Figure 18B:
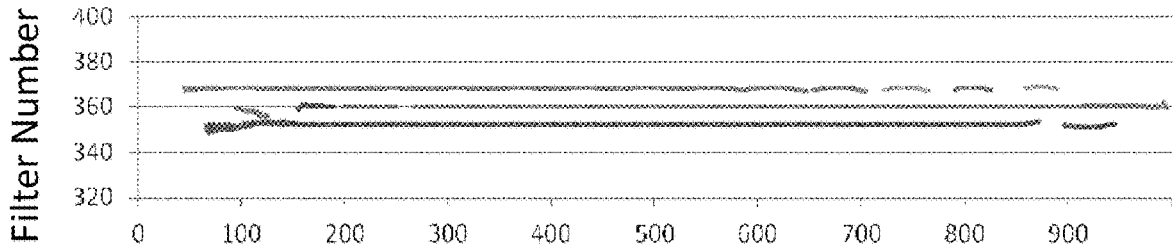
Figure 18C:
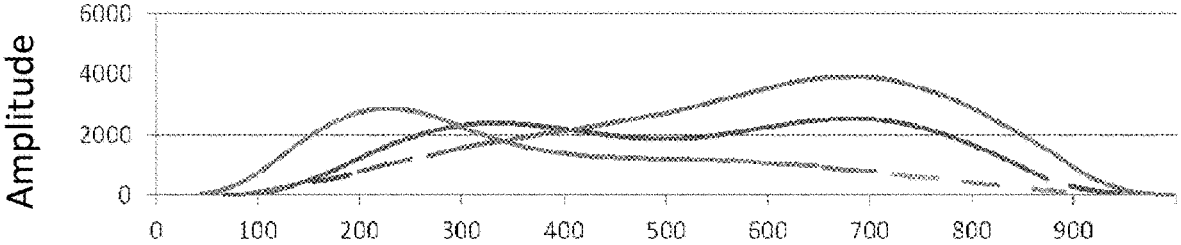
Figure 18D:
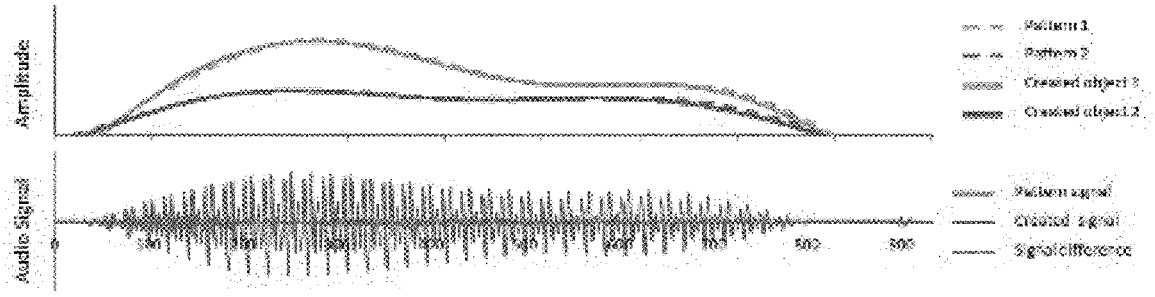
FIG. 18*d* shows an audio signal composed of two frequencies (dashed line) and a signal obtained from the decomposition, with enabled correction system.

Yet another type of correction according to the invention, performed by the correcting system 4, is shown in FIG. 18*a*, FIG. 18B and FIG. 18C. The distortion manifests itself as an object splitting into pieces which are independent objects. This splitting can be caused e.g. by a phase fluctuation in an input signal's component, an interference or mutual influence of closely adjacent objects. The correction of distortions of this type requires the correcting circuit 4 to perform an analysis of the functions of envelope and frequency and to demonstrate that said objects should form an entirety. The correction is simple and is based on combination of the identified objects into one object.

A task of the correcting system 4 is also to remove objects having an insignificant influence on the audio signal's sound. According to the invention it was decided, that such objects can be the ones having the maximal amplitude which is lower than 1% of the maximal amplitude present in the whole signal at a given time instant. Change in the signal at the level of 40 dB should not be audible.

The correcting system performs generally the removal of all irregularities in the shape of sound objects, which operations can be classified as: joining of discontinuous objects, removal of objects' oscillations near the adjacent ones, removal of insignificant objects, as well as the interfering ones, lasting too shortly or audible too weakly.

To illustrate the results of the use of the method and the system for sound signal decomposition a fragment of stereo audio signal sampled at 44100 samples per second has been tested. The signal is a musical composition including sound of guitar and singing. The plot shown in FIG. 19*a* illustrating two channel includes ca. 250000 samples (ca. 5.6 sec.) of the recording.

Figure 19A:
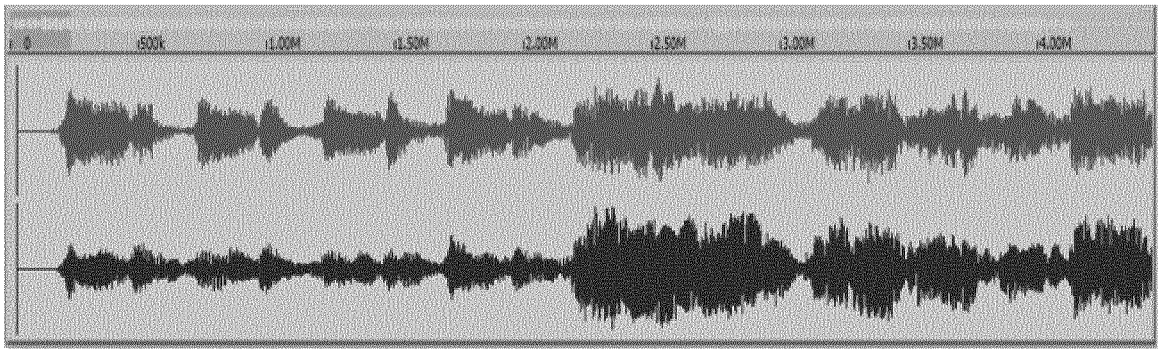
FIGS. 19*a*, 19*b*, 19*c*, 19*d*, 19*e*, 19*f*, 19*g*, 19*h* show the process of extracting sound objects from an audio signal and synthesis of an audio signal from sound objects.
Figure 19B:
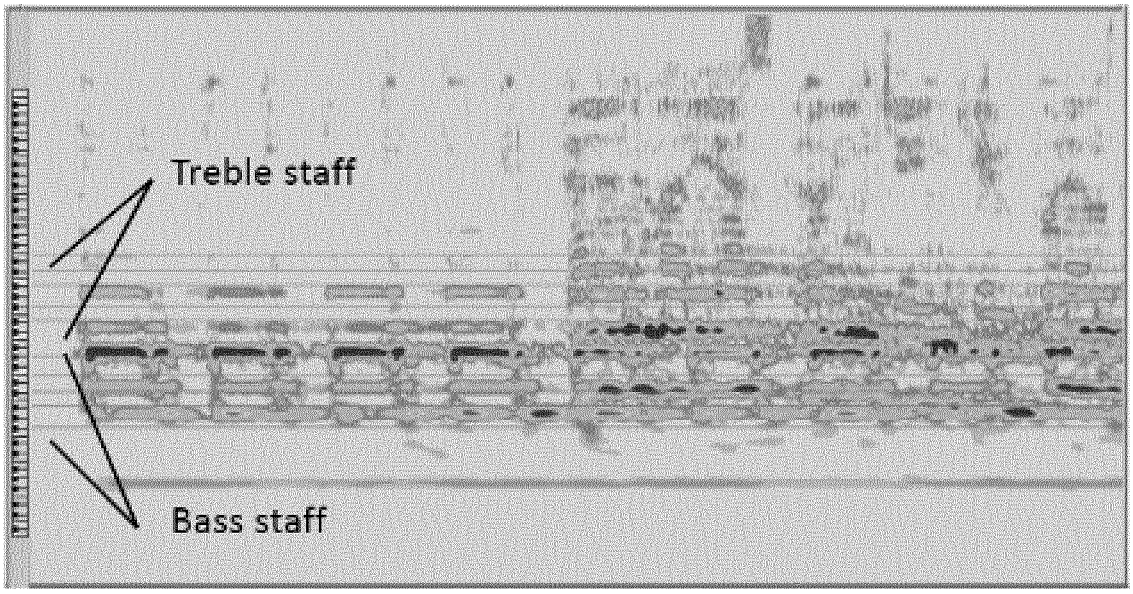

FIG. 19*b* shows a spectrogram resulting from the operation of the filter bank 2 for the audio signal's left channel (upper plot in FIG. 19*a*). The spectrogram includes the amplitude at the output of 450 filters having frequency from C2=16.35 Hz up to e6=10548 Hz. On the left side of the spectrogram a piano keyboard has been shown as reference points defining the frequency. Furthermore, staffs with bass clef and a staff with treble clef above have been marked. The horizontal axis of the spectrogram corresponds to time instants during a composition, while the darker color in the spectrogram indicates a higher value of the filtered signal's amplitude.

Figure 19C:
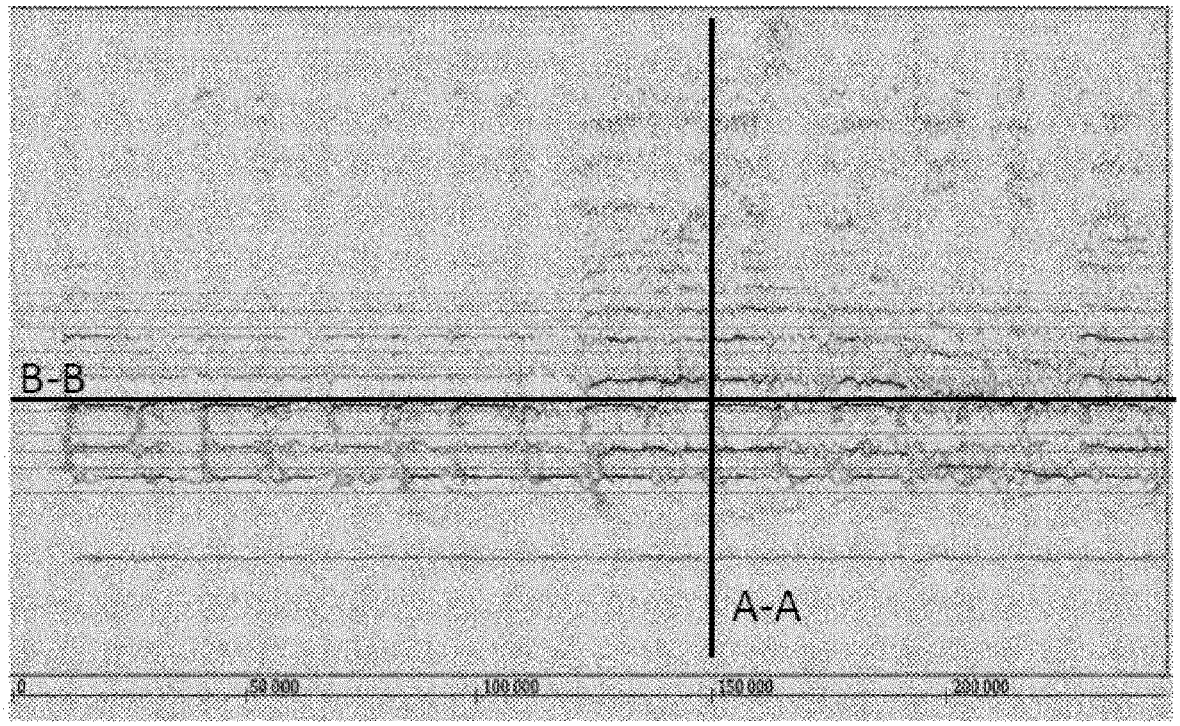

FIG. 19*c* shows the result of operation of the voting system 32. Comparing the spectrogram in FIG. 19*b* with the spectrogram in FIG. 19C it can be seen that wide spots representing signal composing elements have been replaced by distinct lines indicating precise localization of said composing elements of the input signal.

Figure 19D:
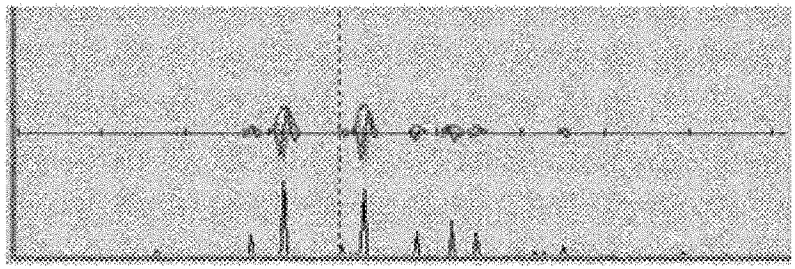

FIG. 19*d* shows a cross-section of the spectrogram along the A-A line for the 149008th sample and presents the amplitude in function of frequency. The vertical axis in the middle indicates the real component and the imaginary component and the amplitude of the spectrum. The vertical axis at the right side shows peaks of the voting signal, indicating the temporary localization of audio signal composing elements.

Figure 19E:
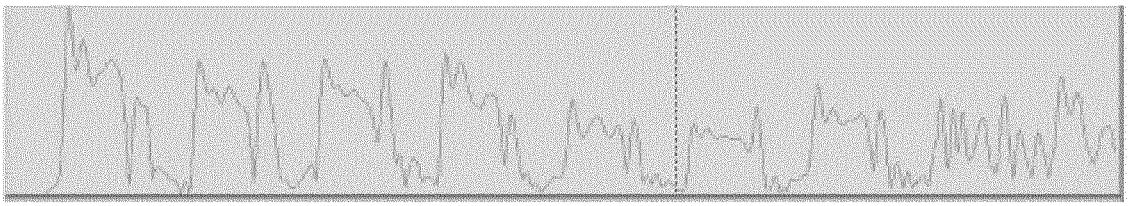

FIG. 19*e* is a cross-section of the spectrogram along the line BB at the frequency of 226.4 Hz. The plot shows the amplitude of the spectrum at the output of the filter 2 with the number n=182.

Figure 19F:
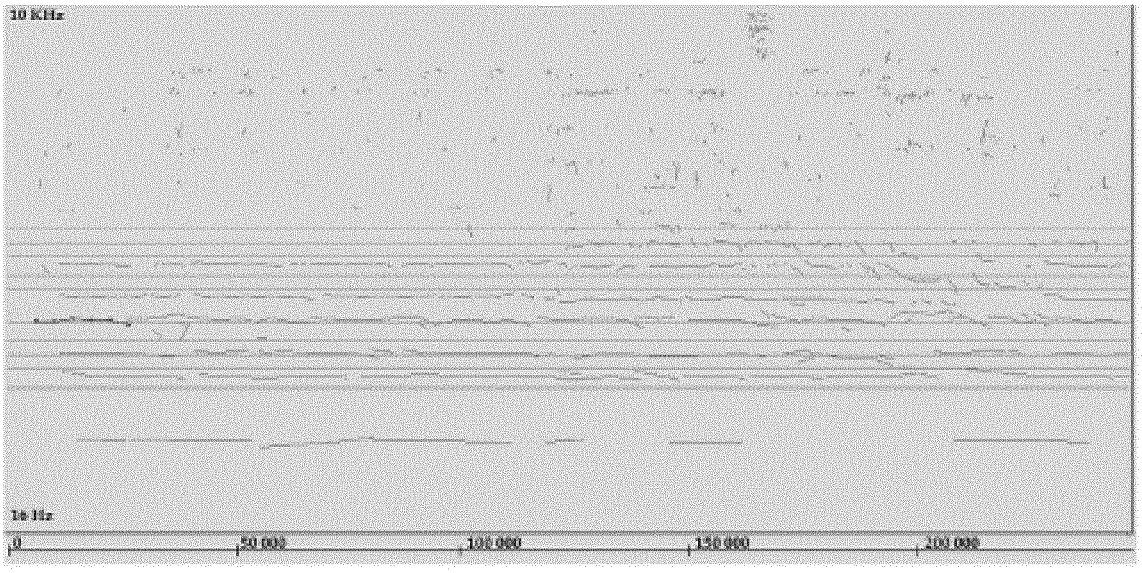

In FIG. 19*f* sound objects are shown (without operation of the correcting system 4). The vertical axis indicates the frequency, while the horizontal axis indicates time expressed by the number of the sample. In the tested fragment of the signal 578 objects have been localized, which are described by 578+995=1573 points. To store these objects ca. 9780 bytes are required. The audio signal in FIG. 19*a* comprising 250000 samples in the left channel requires 500 000 bytes for direct storing, which in the case of using the signal decomposition method and sound objects according to the invention leads to a compression at the level of 49. The use of correcting system 4 further improves the compression level, due to removal of objects having a negligible influence on the signal's sound.

Figure 19G:
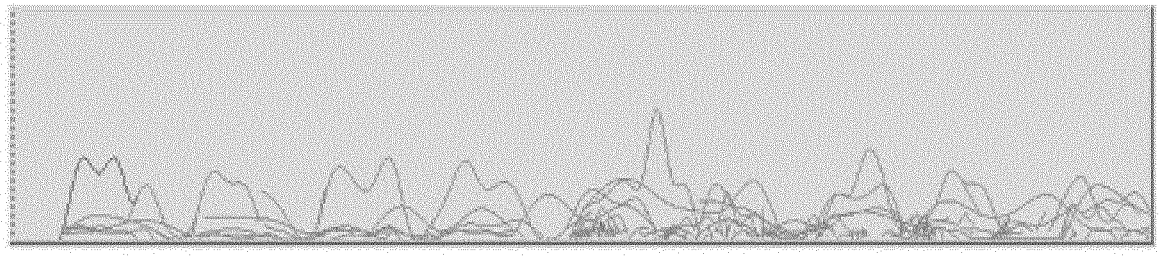

In FIG. 19*g* there are shown amplitudes of selected sound objects, shaped with the use of already determined characteristic points by means of smooth curves created of third order polynomials. In the figure there are shown objects with amplitude higher than 10% of the amplitude of the object with the highest amplitude.

As a result of using the method and the system for signal decomposition according to the invention one obtains sound objects according to the invention, which can serve for an acoustic signal synthesis.

More specifically, a sound object comprises an identifier indicating the object's location relative to the beginning of the track and the number of points included in the object. Each point contains the position of the object in relation to the previous point, the change of the amplitude with respect to the previous point, and a change of pulsation (expressed on a logarithmic scale) against the pulsation of the previous point. In a properly built object amplitude of the first and last point should be zero. If it is not, then in the acoustic signal such amplitude jump can be perceived as a crack. An important assumption is that objects begin with a phase equaling zero. If not, the starting point should be moved to the location in which the phase is zero, otherwise the whole object will be out of phase.

Such information is sufficient to construct an audio signal represented by an object. In the simplest case, by using parameters included in the points it is possible to determine a polygonal line of an amplitude's envelope and a polygonal line of pulsation changes. To improve the sound signal and remove high frequency generated in places of the breaks of the curves one can generate a smooth curve in the form of a polynomial of second or higher order, whose subsequent derivatives are equal in the peaks of the polygonal line (e.g. cubic spline).

In the case of linear interpolation, the equation describing the section of the audio signal from one to the next point may be in the form:

$$\text{AudioSignal}P_i(t)=(A_{(i)}+t*A_{i+1}/P_{(i+1)})*(\cos*\Phi_i+t*(\omega_i+\omega_{(i+1)}/P_{(i+1)}))$$

Where: $A_i$—amplitude of point i $P_i$—position of point i $\omega_i$—angular frequency of point i $\Phi_i$—phase of point i, $\Phi_0=0$ Object's audio signal composed of the P points is the sum of offset segments described above. In the same way, the complete audio signal is the sum of offset signals of objects.

Figure 19H:
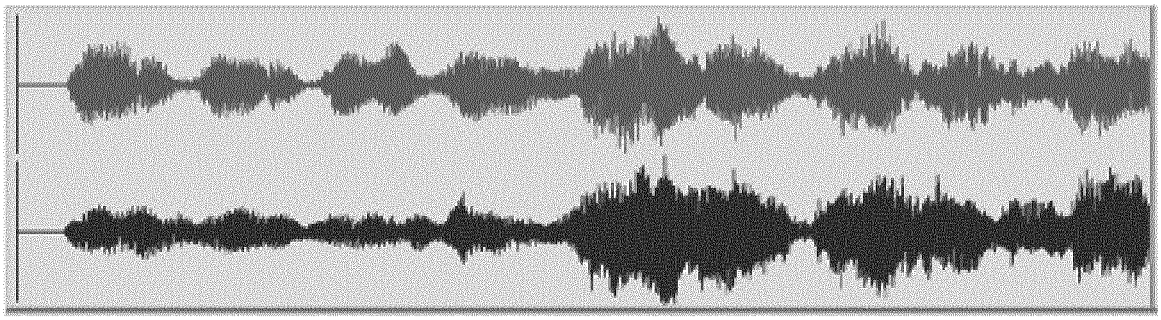

A synthesized test signal in FIG. 19*a* is shown in FIG. 19*h*.

The sound objects according to the invention have a number of properties enabling their multiple applications, in particular in processing, analysis and synthesis of sound signals. Sound objects can be acquired with the use of the method for signal decomposition according to the invention as a result of an audio signal decomposition. Sound objects can be also formed analytically, by defining values of parameters shown in FIG. 14*d*. A sound object database can be formed by sounds taken from the surrounding environment or created artificially. Below some advantageous properties of sound objects described by points having three coordinates are listed:

1) Based on parameters describing sound objects it is possible to determine the function of amplitude and frequency variation, and to determine location in respect to other objects, so that an audio signal can be composed of them.

2) One of the parameters which describe sound objects is the time, thanks to which the objects can be shifted, shortened and lengthened in the time domain.

3) A second parameter of sound objects is the frequency, thanks to which the objects can be shifted and modified in the frequency domain.

4) A next parameter of sound objects is the amplitude, thanks to which envelopes of sound objects can be modified.

5) Sound objects can be grouped, by selecting e.g. the ones present in the same time or/and the ones with frequencies being harmonics.

6) Grouped objects can be separated from or appended to an audio signal. This allows to create a new signal from a number of other signals or to split a single signal into a number of independent signals.

7) Grouped objects can be amplified (by increasing their amplitude) or silenced (by decreasing their amplitude).

8) By modifying proportions of harmonic amplitude included in a group of objects it is possible to modify the timbre of the grouped objects.

9) It is possible to modify the value of all grouped frequencies by increasing or decreasing frequencies of harmonics.

10) It is possible to modify audible emotions contained in sound objects, by modifying the slope (falling or raising) of component frequencies.

11) By presenting an audio signal in the form of objects described by points with three coordinates it is possible to significantly reduce the number of required data bytes without loss of information contained in the signal.

Considering the properties of sound objects, a great deal of applications can be defined for them. The exemplary ones include:

1) Separation of audio signal sources such as instruments or speakers, based on proper grouping of sound objects present in the signal.
2) Automatic generation of musical notation for individual instruments from an audio signal.
3) Devices for automatic tuning of musical instruments during ongoing musical performance.
4) Forwarding the voice of separated speakers to speech recognition systems.
5) Recognition of emotion contained in separated voices.
6) Identification of separated speakers.
7) Modification of the timbre of recognized instruments.
8) Swapping the instruments (e.g. a guitar playing instead of a piano);
9) Modification of a voice of a speaker (raising, lowering, conversion of emotion, intonation).
10) Swapping of voices of speakers.
11) Synthesis of a voice with the possibility of emotion and intonation control.
12) Smooth joining of speeches.
13) Voice control of devices, even in an environment with interference.
14) Generation of new sounds, "samples", unusual sounds.
15) New musical instruments.
16) Spatial management of sound.
17) Additional possibilities of data compression.

Further Embodiments

According to an embodiment of the invention, a method for decomposition of acoustic signal into sound objects having the form of sinusoidal wave with slowly-varying amplitude and frequency, comprises a step of determining parameters of short term signal model and a step of determining parameters of long term signal model based on said short term parameters, wherein a step of determining parameters of a short term signal model comprises a conversion of the analogue acoustic signal into a digital input signal $P_{IN}$ and wherein in said step of determining parameters of short term signal model the input signal $P_{IN}$ is then split into adjacent sub-bands with central frequencies distributed according to logarithmic scale by feeding samples of the acoustic signal to the digital filter bank's input, each digital filter having a window length proportionally to the nominal central frequency at each filter's (20) output the real value FC(n) and the imaginary value FS(n) of the filtered signal is determined sample by sample, and then based on this the frequency, the amplitude and the phase of all detected constituent elements of said acoustic signal are determined sample by sample, an operation improving the frequency-domain resolution of said filtered signal is executed sample by sample and involves at least a step of determining the frequency of all detected constituent elements based on maximum values of the function FG(n) resulting from a mathematical operation reflecting the number of neighboring filters (20) outputting an angular frequency value substantially similar to an angular frequency value of each consecutive filter (20), and in that in said step of determining parameters of long term signal model:

for each detected element of said acoustic signal an active object in an active objects database (34) is created for its tracking subsequent detected elements of said acoustic signal are associated sample by sample with at least selected active objects in said active objects database (34) to create a new active object or to append said detected element to an active object, or to close an active object for each active object in the database (34) values of the envelope of amplitude and values of frequency and their corresponding time instants are determined not less frequently than once per period of duration of a given filter's (20) window W(n) so as to create characteristic points describing slowly-varying sinusoidal waveform of said sound object at least one selected closed active object is transferred to a database of sound objects (35) to obtain at least one decomposed sound object, defined by a set of characteristic points with coordinates in time-frequency-amplitude space.

The method may further comprise a step of correcting selected sound objects which involves a step of correcting of amplitude and/or frequency of selected sound objects as to reduce an expected distortion in said sound objects, the distortion being introduced by said digital filter bank.

Improving the frequency-domain resolution of said filtered signal may further comprise a step of increasing window length of selected filters.

The operation of improving the frequency-domain resolution of said filtered signal may further comprise a step of subtracting an expected spectrum of assuredly located adjacent sound objects from the spectrum at the output of the filters.

The operation of improving the frequency-domain resolution of said filtered signal may further comprise a step of subtracting an audio signal generated based on assuredly located adjacent sound objects from said input signal.

A system for decomposition of acoustic signal into sound objects having the form of sinusoidal waveforms with slowly-varying amplitude and frequency according to a further embodiment of the invention comprises a sub-system for determining parameters of a short term signal model and a sub-system for determining parameters of a long term signal model based on said parameters, wherein said subsystem for determining short term parameters comprises a converter system for conversion of the analogue acoustic signal into a digital input signal $P_{IN}$ wherein said subsystem for determining short term parameters further comprises a filter bank (20) with filter central frequencies distributed according to logarithmic distribution, each digital filter having a window length proportionally to the central frequency wherein each filter (20) is adapted to determine a real value FC(n) and an imaginary value FS(n) of said filtered signal, said filter bank (2) being connected to a system for tracking objects (3), wherein said system for tracking objects (3) comprises a spectrum analyzing system (31) adapted to detect all constituent elements of the input signal $P_{IN}$, a voting system (32) adapted to determine the frequency of all detected constituent elements based on maximum values of the function FG(n) resulting from a mathematical operation reflecting the number of neighboring filters (20) which output an angular frequency value substantially similar to an angular frequency value of each consecutive filter (20), and in that said subsystem for determining long term parameters comprises a system for associating objects (33), a shape forming system (37) adapted to determine characteristic points describing slowly-varying sinusoidal waveforms, an active objects database (34) and a sound objects database (35).

The system for tracking objects (3) may further be connected with a correcting system (4) adapted to correct the amplitude and/or the frequency of individual selected sound objects so as to reduce an expected distortion in said sound objects introduced by said digital filter bank and/or adapted to combine discontinuous objects and/or to remove selected sound objects.

The system may further comprise a resolution improvement system (36) adapted to increase window length of selected filter and/or to subtract an expected spectrum of assuredly located adjacent sound objects from the spectrum at the output of the filters and/or to subtract an audio signal generated based on assuredly located adjacent sound objects from said input signal.

I claim:

1. A method for decomposing an acoustic signal into digital sound objects, a digital sound object representing a component of the acoustic signal, the component having a waveform, the method comprising:

converting the analogue acoustic signal into a digital input signal (PIN), wherein the digital signal comprises samples of the acoustic signal;

determining, for each sample, an instantaneous frequency component of the digital input signal, using a digital filter bank comprising digital filters (n);

determining, for each sample, an instantaneous amplitude of the instantaneous frequency component;

determining, for each sample, an instantaneous phase of the digital input signal associated with the instantaneous frequency;

creating at least one digital sound object, wherein the digital sound object includes the determined instantaneous frequency, phase and amplitude; and storing the digital sound object in a sound object database, characterized in that, for each sample, for each filter (n), locations of frequencies present in the acoustic signal are determined based on an intersection of a value of an angular frequency at the output of each filter (n) and its nominal angular frequency.

2. The method of claim 1, wherein a digital filter in the digital filter bank has a window length proportional to its central frequency.

3. The method of claim 2, wherein central frequencies of the filter bank are distributed according to a logarithmic scale.

4. The method of claim 3, characterized in that improving the frequency-domain resolution of said filtered signal further comprises a step of increasing the window length of selected filters.

5. The method of claim 1, characterized in that an operation improving the frequency-domain resolution of said filtered signal is executed sample by sample.

6. The method of claim 5, characterized in that the operation of improving the frequency-domain resolution of said filtered signal further comprises the step of subtracting an expected spectrum of located adjacent sound objects from the spectrum at the output of the filters.

7. The method of claim 5, characterized in that the operation of improving the frequency-domain resolution of said filtered signal further comprises a step of subtracting an audio signal generated based on located adjacent sound objects from said input signal.

8. The method of claim 1, wherein the step of determining an instantaneous frequency component takes into account one or more instantaneous frequency components determined using adjacent digital filters of the digital filter bank.

9. The method of claim 1, wherein the instantaneous frequency is tracked over subsequent samples of the digital input signal.

10. The method of claim 9, characterized in that values of the envelope of amplitude and values of frequency and their corresponding time instants are determined in order to create characteristic points with coordinates in time-frequency-amplitude space describing the waveform of said sound object.

11. The method of claim 10, characterized in that the values are determined not less frequently than once per period of duration of a given filter's window W(n).

12. The method of claim 9, further comprising the step of correcting an amplitude and/or frequency of selected sound objects as to reduce an expected distortion in said sound objects, the distortion being introduced by said digital filter bank.

13. A digital sound object, the digital sound object comprising at least one parameter set representing a waveform of at least one component of an acoustic signal, generated by a method according to claim 1.

14. A method for generating an audio signal, comprising the steps of:

receiving a digital sound object according to claim 13;

decoding the digital sound object in order to extract at least one parameter set describing a waveform of at least one component of the audio signal;

generating the waveform from the parameter set;

synthesizing the audio signal, based on the generated waveform; and outputting the audio signal.

15. Non-volatile, non-transient computer-readable medium, storing a sound object generated according to claim 1.

* * * * *